US005880386A

United States Patent [19]

Wachi et al.

[11] Patent Number: 5,880,386

[45] **Date of Patent: *Mar. 9, 1999**

[54] MUSICAL INFORMATION PROCESSING SYSTEM WITH AUTOMATIC DATA TRANSFER

[75] Inventors: Masatada Wachi; Hideo Suzuki; Motoichi Tamura; Masashi Hirano, all of Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 756,653

[22] Filed: Nov. 26, 1996

[30] Foreign Application Priority Data

Nov. 30, 1995 [JP] Japan ..... 7-334179

[51] Int. Cl.[6] ..... G10H 7/00

[52] U.S. Cl. ..... 84/601; 84/602; 84/609

[58] Field of Search ..... 84/601, 602, 609–614, 84/634–638

[56] References Cited

U.S. PATENT DOCUMENTS

| | | | |
|---|---|---|---|
| 4,922,794 | 5/1990 | Shibukawa | 84/601 |
| 5,020,410 | 6/1991 | Sasaki . | |
| 5,153,829 | 10/1992 | Furuya et al. . | |
| 5,250,747 | 10/1993 | Tsumura . | |
| 5,262,580 | 11/1993 | Tanaka et al. . | |
| 5,300,723 | 4/1994 | Ito | 84/601 |
| 5,369,216 | 11/1994 | Miyamoto | 84/609 |
| 5,461,192 | 10/1995 | Imaizumi | 84/634 |
| 5,508,471 | 4/1996 | Shimada | 84/610 |
| 5,567,900 | 10/1996 | Higashi | 84/602 |
| 5,576,506 | 11/1996 | Kawashima et al. | 84/602 |
| 5,613,147 | 3/1997 | Okamura et al. | 84/602 X |

FOREIGN PATENT DOCUMENTS

| | | |
|---|---|---|
| 0 465 246 | 1/1992 | European Pat. Off. . |
| 0 484 043 | 5/1992 | European Pat. Off. . |
| WO 92/08192 | 5/1992 | WIPO . |

*Primary Examiner*—Stanley J. Witkowski
*Attorney, Agent, or Firm*—Graham & James, LLP

[57] ABSTRACT

In each of terminal devices, there is stored user profile information on the corresponding device. The user profile information includes data identifying the user, type and name of the device, information regarding a CPU, memory and operating system (OS) provided in the device, and information regarding various data and program stored in the device. When desired musical information data is to be downloaded from a host computer, a request for downloading optimum data is sent to the host computer. This permits efficient loading of data most suitable for system conditions. When data or program is to be loaded from a recording medium, such as a CD-ROM, rather than a communication network, efficient loading is permitted in a similar manner.

14 Claims, 19 Drawing Sheets

PROCESSING IN TERMINAL

MUSICAL INFORMATION PROCESSING SYSTEM WITH AUTOMATIC DATA TRANSFER

BACKGROUND OF THE INVENTION

The present invention relates generally to information processing systems, and more particularly to an improved information processing system which is capable of efficiently loading various data, such as music data, from a network system, recording medium or the like to a terminal device.

With widespread use of computer networks such as personal computer communication networks and Internet, various communication systems have been built on a global basis which communicate various data and information using communication networks such as telephone line networks. The use of such communication networks permits prompt and easy transmission of various data and information. It has also been getting very popular to process music information by means of a personal computer. In addition to music "sequencer" software, karaoke (singing to recorded music for entertainment) software has been developed which enables karaoke performance using a personal computer. In using such sequencer and karaoke software, how to supply music piece data (particularly those of newly-released music pieces) to users efficiently is a very important issue.

The users are able to obtain desired music data easily and promptly via a communication network. Similarly, a renewed version of various software such as karaoke or tone generating software can be delivered to users promptly via a communication network.

According to the known approach, desired data are downloaded from the network by a user first selecting the data from a data directory of a host system. However, with such an approach, the same data as already furnished or stored in the user (terminal device) tend to be erroneously downloaded in an overlapping manner, or completely irrelevant data may be selected by the user. Further, the known approach requires a cumbersome selecting operation on the part of the user and would inadvertently increase the network traffic to an excessive degree. This would result in waste of money where a pay communication network is utilized. The same problems could occur where data is loaded from a CD-ROM or other recording medium into a personal computer.

SUMMARY OF THE INVENTION

It is therefore an object of the present invention to provide a musical information processing system which allows optimum, data to be efficiently loaded by determining system and program possessing conditions in a user system.

It is another object of the present invention to provide a musical information processing system which is applied to loading management of data or program within a user system as well as data acquisition from a communication network into the user system and which permits efficient loading of predetermined data or program from a predetermined recording medium in the system.

In order to accomplish the above-mentioned objects, the present invention provides a musical information processing system which comprises a processing section, a storage section connected with the processing section and having stored therein at least first data, and a data supply section connected with the processing section and storage section and having stored therein various data, wherein to execute predetermined processing based on the first data, the processing section sends the data supply section a request for transfer of second data if the second data is not stored in the storage section, and the data supply section transfers the second data to the storage section in response to the request for transfer.

In one typical example of the above-mentioned musical information processing system, the processing and storage sections are provided in a user's terminal, while the data supply section is provided in a host device or another terminal as a database for access via a communication network. Alternatively, the processing section may be in another terminal or host device connected to the network, and the storage section may be incorporated in a terminal device or connected to the network.

In order to execute the predetermined process, second data are needed in addition to the first data. For example, where the predetermined processing is an automatic reproduction of a given piece of music (music piece), the first data comprise automatic performance sequence data (containing data designating notes and tone generation timing), which are necessary for total reproduction of the music piece, and the second data comprise waveform data and tone generator program data necessary for reproduction of individual tones. The storage section of a terminal device has stored therein at least the first data and may also contain some of the second data. When a selection to reproduce a music piece is made in the terminal, the predetermined processing (in this case, automatic music piece reproduction process) is executed on the basis of the first data, but for complete execution of the predetermined process, it is necessary for the second data to be possessed by or stored in the storage section. The processing section ascertains whether or not the second data necessary for the predetermined processing are stored in the storage section. If all or some of the second data necessary for the predetermined processing are not stored in the storage section, the processing section sends the data supply section a request for transfer of the lacking data. If the data supply section is in the form of a database for the entire musical information processing system, the database contains all the data needed in the system (or at least all of the second data) and thus is able to transfer the requested second data to the storage section in response to the request of transfer. A determination as to ether or not the second data are stored in the storage section may itself be made by the processing section, or by a processor of the data supply section in response to the terminal's request for transfer.

This arrangement permits selective transfer of only some of the second data that are not actually stored in the storage section, thus achieving efficient downloading.

With the present invention thus constructed, optimum data or program can be automatically downloaded according to system and program-possessing conditions of a user's terminal. Further, necessary data to be downloaded can be readily selected without a user's cumbersome selecting operation, and the same data as already possessed by a user's terminal can be prevented from being downloaded in to the user in an overlapping manner, with the result that wasteful processing can be avoided. Thus, the present invention achieves superior benefits, such as effective prevention of increase in the network traffic.

In another example of the musical information processing system, the data supply section is connected with the processing and storage sections without an intervening communication network. In such a case, the data supply section may also be provided in a user's terminal, and the principle of the present invention is applied to loading management of data or program within the user system. The data supply section may be in the form of a database having a relatively small capacity, e.g., a portable recording medium such as a CD-ROM.

Thus, even when data or program is loaded from a recording medium, such as a CD-ROM, to an internal memory, such as a RAM, in the user system, necessary data to be downloaded can be readily selected without a user's cumbersome selecting operation, and the same data as already stored in the internal memory can be prevented from being downloaded in an overlapping manner, with the result that wasteful processing can be avoided.

Another aspect of the present invention provides a musical information processing system which comprises a processing section, a storage section connected with the processing section and having stored therein at least music data, and a data supply section connected with the processing section and storage section and having stored therein various data, wherein the music data contains designation data for designating music-related data of the various data that is necessary for executing predetermined processing based on the music data, and when the processing section executes the processing based on the music data, the data supply section transfers to the storage section the music-related data designated by the designation data.

Also, in this case, if the predetermined processing is an automatic reproduction of a given music piece, the music data comprise automatic performance sequence data (containing data designating notes and tone generation timing) which are necessary for total reproduction of the music piece, and the music-related data comprise waveform data and tone generator program data necessary for reproduction of individual tones. The storage section has stored therein at least the music data and may also contain some of the music-related data. The characteristic point of the musical information processing system is that the music data contain not only the automatic performance sequence data but also such data designating music-related data needed for execution of the predetermined processing (automatic music piece reproduction processing). Only some of the music-related data that are necessary for reproduction of a music piece (waveform data or tone generator program data) may be selectively transferred from the data supply section on the basis of the designating data and then stored into the storage section. What sort of data should be supplied as the necessary music-related data is automatically specified by the designating data, and this can reduce a user's load in loading data. Further, because the amount of the designating data is by far smaller than the amount of the music-related data, the total amount of the music data prestored in the storage section can be reduced to a substantial degree.

BRIEF DESCRIPTION OF THE DRAWINGS

For better understanding of various features of the present invention, the preferred embodiments of the invention will be described in detail hereinbelow with reference to the accompanying drawings, in which.

DETAILED DESCRIPTION OF THE PREFERRED EMBODIMENTS

Preferred embodiments of the present invention will be described hereinafter in relation to an information processing system which is designed to supply (deliver or load) various music data, such as music piece data and waveform data and tone generating program.

<General Structure of the System>

Figure 1:
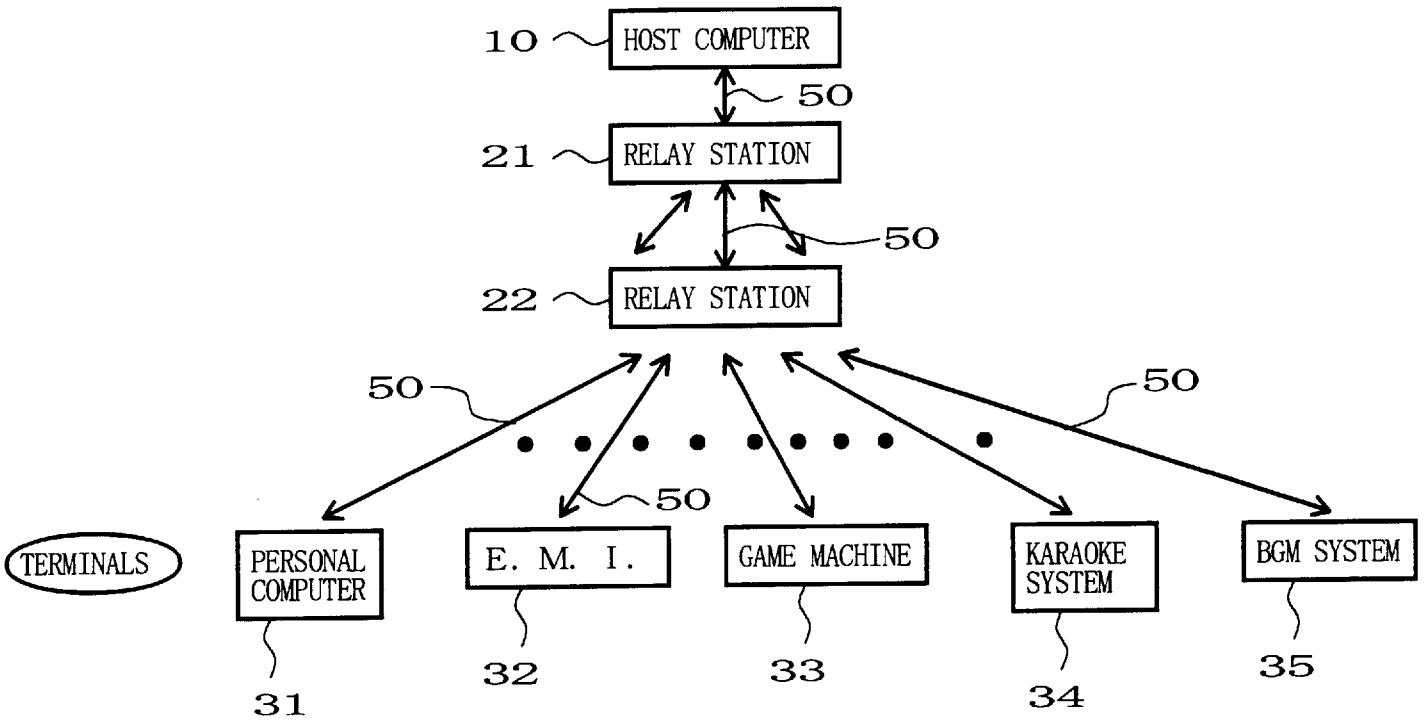
FIG. 1 is a block diagram illustrating a general structure of an embodiment of an information processing system according to the present invention.

FIG. 1 is a block diagram showing a general structure of an embodiment of an information processing system according to the present invention. As shown, the information processing system generally comprises a host computer 10, relay stations 21 and 22, network lines 50 such as public telephone lines, and terminal devices 31 to 35 connected to the host computer 10 via the network lines 50 and relay stations 21, 22. The terminal devices 31 to 35 include a personal computer 31, an electronic musical instrument (E.M.I.) 32, a game machine 33, a communication karaoke system 34, and a BGM system based, for example, on cable broadcasting. Each of the terminal devices 31 to 35 is connected to the network line 50 by means of a MODEM (Modulator-Demodulator) if the corresponding line 50 is a public telephone line, and also has a function to transmit and receive data in a predetermined format in accordance with a predetermined protocol if the corresponding network line 50 is a dedicated digital line. Any other sorts of terminal devices than the above-mentioned may be used as long as they are connectable to a network.

The relay stations 21 and 22 may be local telephone offices if the lines used are commercial circuit lines, or may comprise server computers if the lines used are those of LAN (Local Area Network). If the network is a small-scale network, the relay stations 21 and 22 may be eliminated so that the host computer 10 are connected directly with the terminal devices 31 to 35. The communication network lines may partly rely on ground wave communication as by microwave, or radio communication as by satellite. Further, as the data communication method, a method of transmitting digital data as a background of voice communication may be employed other than the conventionally-known digital communication method.

In response to a download request issued from any one of the terminal equipments 31 to 35 or designation made on the host computer 10, the computer 10 transmits, to the terminal device, desired music piece data, performance software for performing a music piece, or tone generator (T.G.) software for simulating a tone generator (software tone generator).

Figure 2A:
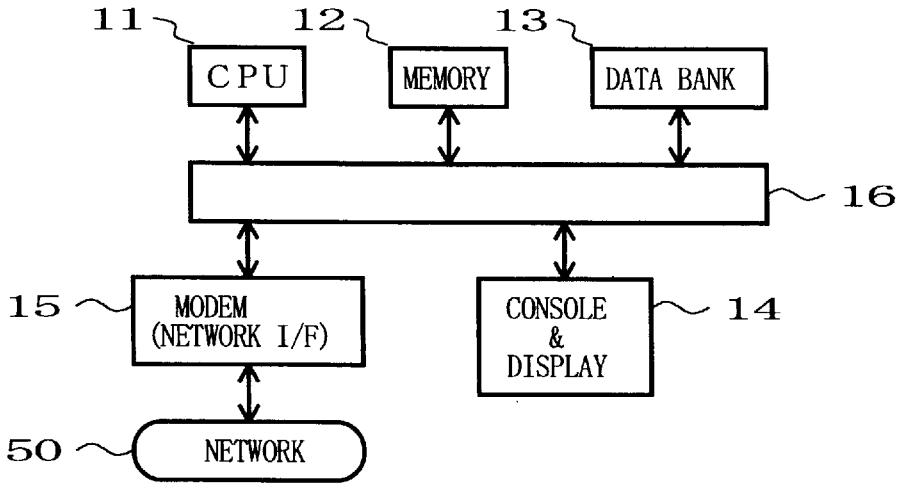
FIG. 2A is a block diagram illustrating an exemplary structure of a host computer of FIG. 1.

An exemplary structure of the host computer 10 is shown in FIG. 2A. As shown in FIG. 2A, the host computer 10 comprises a central processing unit (CPU) 11, a memory 12 having prestored therein various control programs and data, a data bank 13 having prestored therein music piece data, waveform data and various data of performance and tone generator software, a console and display 14, a network interface circuit 15, such as a MODEM, connected to the network line 50, and a bus 16.

Figure 2B:
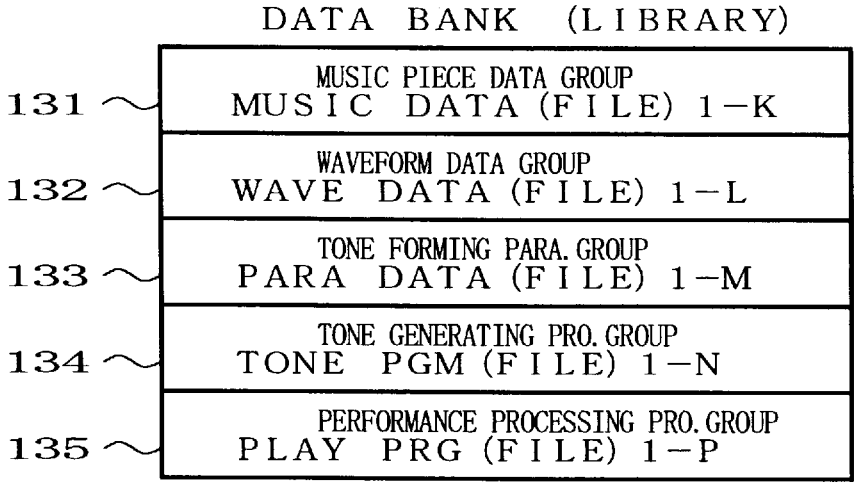
FIG. 2B shows examples of several data groups stored in a data bank of FIG. 2A.

FIG. 2B shows examples of a plurality of data groups stored in the data bank 13: music piece data group (MUSIC DATA(FILE) 1–K) 131; waveform data group (WAVE DATA(FILE) 1–L) 132; tone forming parameter group (PARA DATA(FILE) 1–M) 133; tone generating program group (TONE PGM(FILE) 1–N) 134 such as various control programs for tone generator; and performance processing program (PLAY PRG(FILE) 1–P) 135 such as automatic performance programs and karaoke software. These data groups may be stored in any suitable storage or recording medium such as a floppy disk (FD), hard disk (HD), magneto optical disk (MO) or CD-ROM. In this embodiment, the music piece data group (MUSIC DATA(FILE) comprises data for effecting automatic performance.

Figure 3A:
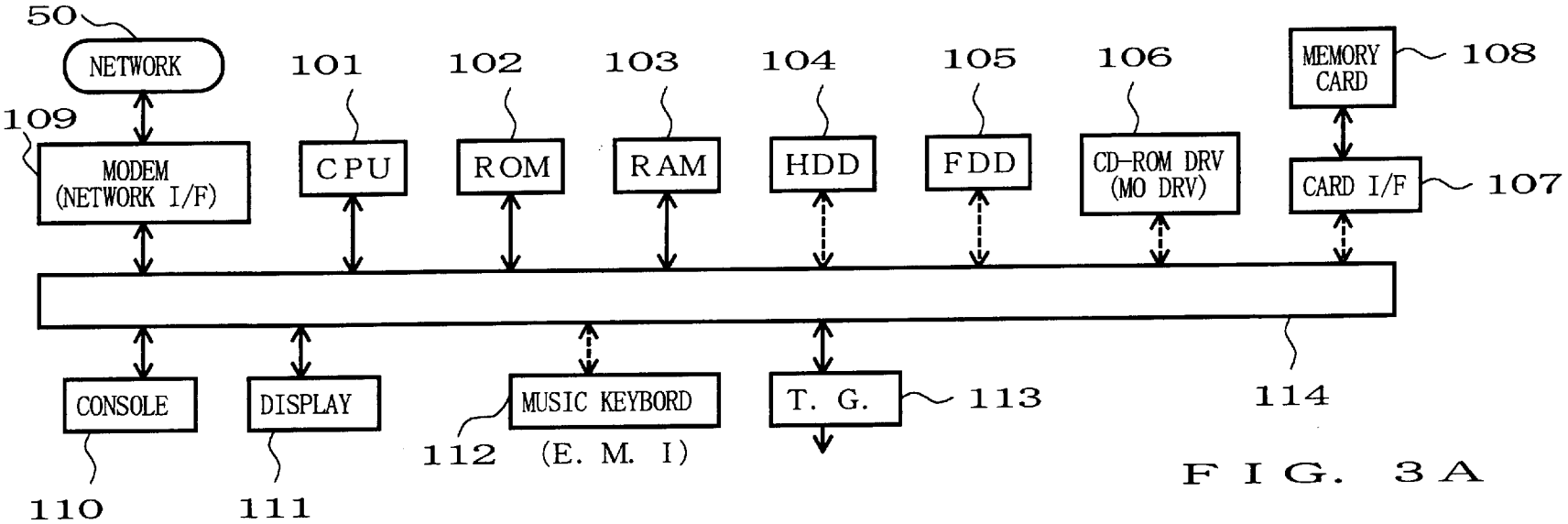
FIG. 3A is a block diagram illustrating an exemplary structure of a terminal device of FIG. 1.

The terminal devices 31 to 35 each connectable to a network are all computer systems which basically have a similar structure as shown in FIG. 3A, although they are different from one another in outer appearance, operating/display section, stored software, etc. depending on the respective types of the devices (i.e., personal computer (PC), karaoke device, game machine, etc.). As shown in FIG. 3A, each of the terminal devices 31 to 35 comprises a CPU 101 for controlling overall operation of the terminal device, a ROM 102 having prestored therein control programs and the like, a RAM 103 for storing various data, a hard disk device 104, a flexible disk device 105, a CD-ROM or MO driver 106, a card interface circuit 107, a memory card 108, a network interface circuit 109 such as a MODEM, a console such as a character keyboard 110, a display device 111, a music keyboard 112 employed where the terminal device is an electronic musical instrument, a tone generator (T.G.) 113, and a system signal path 114. In this embodiment, the "signal path" 114 generically refers to not only a CPU bus but also an extended bus, SCSI (Small Computer System Interface) and other connections based on other connection standards.

In this embodiment, various storage or recording media including the hard disk device 104, flexible disk device 105, CD-ROM or MO driver 106 and memory card 108 are attached to the terminal device in accordance with the specifications for the terminal device; the specifications for the media mounting and connection are different depending on the type of the terminal devices. In the case where the terminal device is to be connected to the CPU bus, the storage media may be connected in various manners, for example, via an interface such as an extended interface circuit or SCSI.

The tone generator 113 may be implemented by only a CODEC (Coder-Decoder) including a digital-to-analog converter (D/A), or by a combination of a CODEC and tone generator hardware including a dedicated LSI, DSP or MPU, or by driving a tone generator device via a MIDI (Musical Instrument Digital Interface). In the case where the tone generator 113 is implemented by only a CODEC, the CODEC is used along with a so-called software tone generator that arithmetically generates tone waveform data by software. In the case where the tone generator 113 is implemented by a combination of a CODEC and tone generator hardware, a board (daughter board) equipped with a tone generator chip or device may be mounted separately on the CODEC, or these elements may be mounted on the CODEC together from the beginning, or these elements and CODEC may all be incorporated in a single LSI.

Figure 3B:
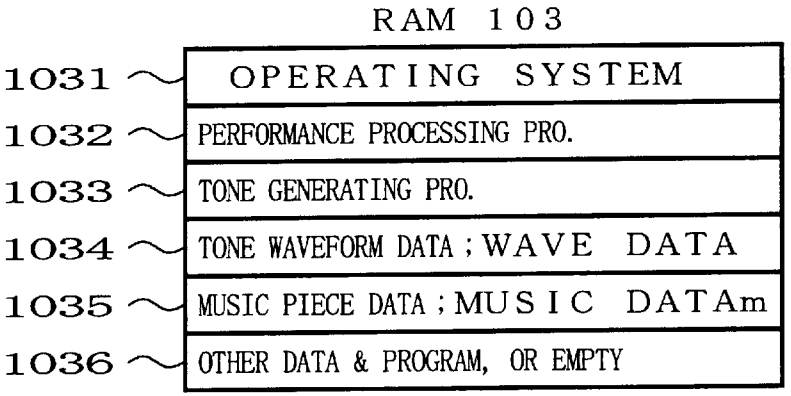
FIG. 3B is a diagram illustrating an exemplary memory map in a RAM of a personal computer of FIG. 1.

FIG. 3B shows an exemplary memory map in the RAM 103 of the personal computer 31 where only the CODEC is mounted as the tone generator 11 to generate tone waveform data by software. As shown, an operating system for the personal computer 31 is stored in storage region 1031, plural sorts of performance processing programs are stored in storage region 1032, and one or more tone generating programs are stored in storage region 1033. Further, a group of tone waveform data (WAVE DATA) is stored in storage region 1034, and music piece data (MUSIC DATA) to be played are stored in storage region 1035. In addition, storage region 1036 stores therein various other data and programs or is sometimes placed in an empty condition.

<Data Structures>

Various data structures used in the present invention will be described below.

Figure 4B:
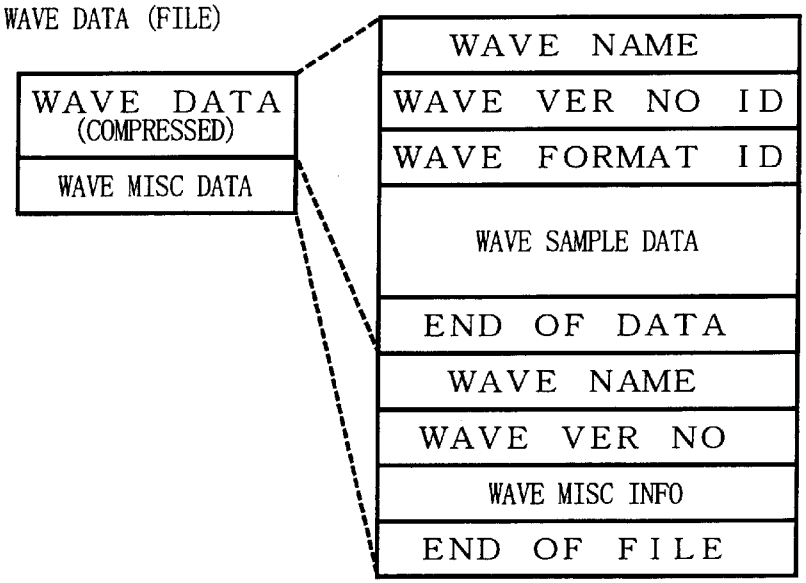
FIG. 4B is a diagram illustrating an exemplary structure of waveform data.
Figure 4A:
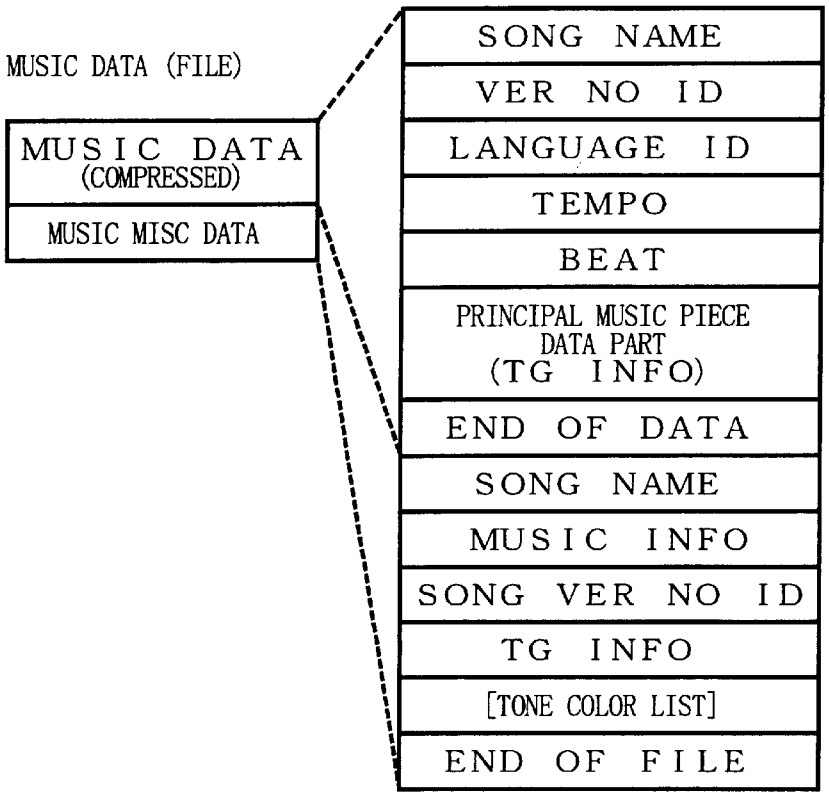
FIG. 4A is a diagram illustrating an exemplary structure of music piece data.

FIG. 4A shows an exemplary structure of music-piece data set or file (MUSIC DATA(FILE)), which generally comprises a principal music-piece data part (MUSIC DATA) and music-piece-related data part (MUSIC MISC DATA) accompanying the principal part. The principal music-piece data part (MUSIC DATA) is stored in the data bank 13 in compressed form, while the music-piece-related data part (MUSIC MISC DATA) is stored in the data bank 13 in uncompressed form. The principal music-piece data part (MUSIC DATA) includes: data identifying a name of the music piece (SONG NAME); data identifying a version number of the music piece data (VER NO ID); data identifying a language to be used to visually display the words of the music piece where the music-piece data set is directed to karaoke singing (LANGUAGE ID); data indicative of a performance tempo of the music piece (TEMPO); data indicative of a beat of the music piece (BEAT); principal performance event data containing data identifying types and occurrence times of individual performance events in the music piece; and data indicative of an end of the principal music-piece data part (END OF DATA). The principal performance event data part also contains information on a tone generator and tone generating program to be used (TG INFO).

In the case where the music piece data is for karaoke singing, words and image data are included in the principal performance event data. Alternatively, performance event data and words (and image) data may be stored separately so that the words (and image) data are read out, in response to a selection that the music piece should be for karaoke singing rather than for a mere performance, so as to execute the performance with the words or image data visually displayed.

The music-piece-related data part (MUSIC MISC DATA) accompanying the principal music-piece data part includes: data identifying a name of the music piece (SONG NAME); information containing a brief explanation of the music piece (MUSIC INFO) and the like; data identifying a version number of the music piece data (SONG VER NO ID); and information on a tone generator and tone generating program associated with the music piece data (TG INFO); and data indicative of an end of the music piece data (END OF FILE). Depending on the situation, the music-piece-related data part (MUSIC MISC DATA) may also include a tone color list enumerating numbers or names of all tone colors to be used in performance of the music piece.

FIG. 4B shows an exemplary structure of waveform data set or file (WAVE DATA(FILE)), which is used in a tone generator to generate a waveform and generally comprises principal waveform data part (WAVE DATA) and waveform-related-data part (WAVE MISC DATA) accompanying the principal waveform data part. The principal waveform data part (WAVE DATA) is stored in the data bank 13 in compressed form, while the waveform-related-data part (MUSIC MISC DATA) is stored in the data bank 13 in uncompressed form. The principal waveform data part (WAVE DATA) includes: data identifying a name of the waveform (WAVE NAME); data identifying a version number of the waveform data (WAVE VER NO ID); information identifying a format of the waveform data (WAVE FORMAT ID); waveform sample data (WAVE SAMPLE DATA); and data indicative of an end of the waveform data (END OF DATA).

The waveform-related-data part (WAVE MISC DATA) includes data identifying a name of the waveform (WAVE NAME); data identifying a version number of the waveform data (WAVE VER ID); information containing a brief explanation of the waveform data (WAVE MISC INFO) and the like; and data indicative of an end of the waveform data (END OF DATA).

Figure 5C:
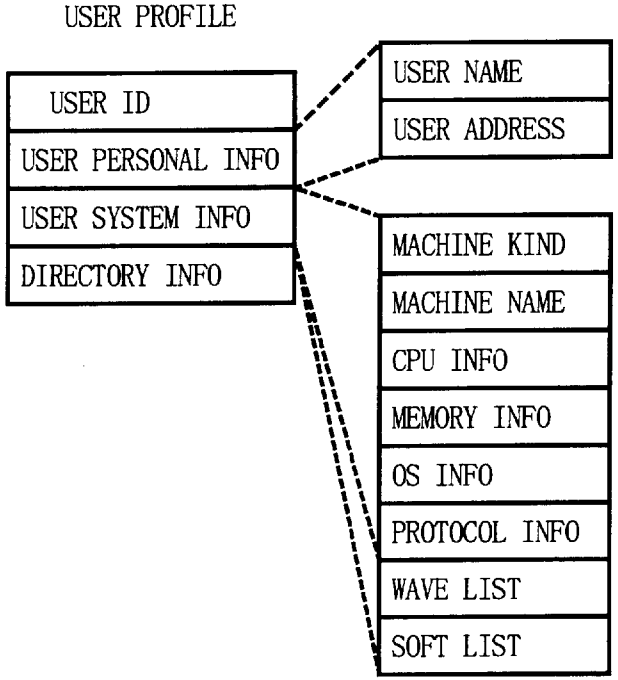
FIG. 5C is a diagram illustrating an exemplary data structure of user profile information.
Figure 5A:
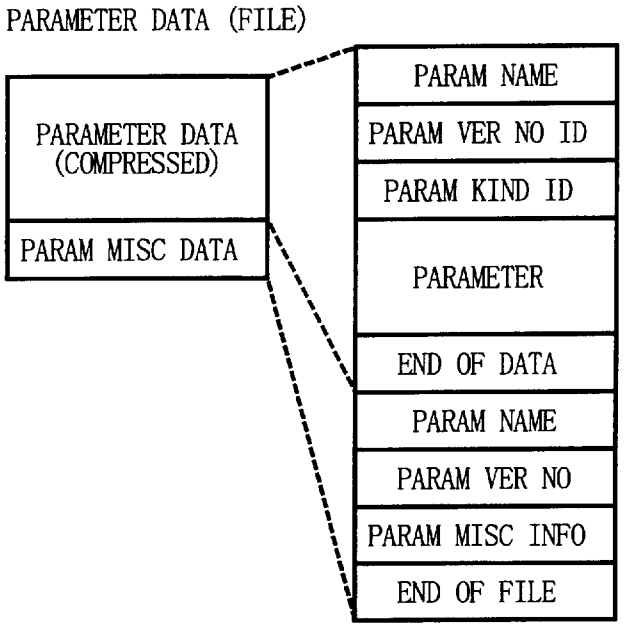
FIG. 5A is a diagram illustrating an exemplary structure of parameter data.

In FIG. 5A, there is shown an exemplary structure of tone forming parameter data set or file (PARAMETER DATA (FILE)), which is used by a tone generator which is designed to arithmetically generate a waveform without using waveform data and which generally comprises principal parameter data part (PARAMETER DATA) and parameter-related data part (PARAM MISC DATA) accompanying the principal parameter data part. The principal parameter data part (PARAMETER DATA) is stored in the data bank 13 in compressed form, while the parameter-related data part (PARAM MISC DATA) is stored in the data bank 13 in uncompressed form. The principal parameter data part (PARAMETER DATA) includes: data identifying a name of the tone forming parameter data (PARAM NAME); data identifying a version number of the tone forming parameter data (PARAM VER ID); data identifying a kind of the tone forming parameter data (PARAM KIND ID); parameter data (PARAMETER); and data indicative of an end of the tone forming parameter data (PARAM VER ID).

The parameter-related data part (PARAM MISC DATA) includes data identifying a name of the tone forming parameter data (PARAM NAME); data identifying a version number of the tone forming parameter data (PARAM VER ID); information containing a brief explanation of the tone forming parameter data (PARAM MISC INFO) and the like; and data indicative of an end of the file (END OF FILE).

Figure 5B:
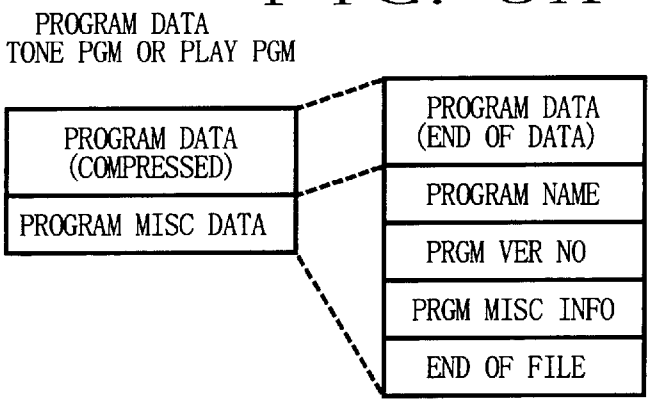
FIG. 5B is a diagram illustrating an exemplary structure of program data.

Tone forming program data set (file) (TONE PGM DATA (FILE)) and performance processing program data set (file) (PLAY PGM DATA(FILE)) have a same data structure as shown in FIG. 5B. That is, each of these program data sets comprises principal program data part (PROGRAM DATA) and program-related data part (PROGRAM MISC DATA). The principal program data part (PROGRAM DATA) is stored in the data bank 13 in compressed form, while the program-related data part (PROGRAM MISC DATA) is stored in the data bank 13 in uncompressed form. As shown, the program-related data part (PROGRAM MISC DATA) includes: data identifying a name of the tone generating program or performance processing program (PROGRAM NAME); data identifying a version number of the program (PRGM VER ID); information containing a brief explanation of the program (PRGM MISC INFO); and data indicative of an end of the file (END OF FILE).

Because the principal data part of each of the above-mentioned data sets is stored in compressed form and the related data part of each of these data sets is stored in uncompressed form, the related data part can be consulted before the corresponding principal data part is downloaded, which will effectively facilitate management as to whether downloading of the principal data part should be effected or not. When the user downloads the compressed data set, the downloaded compressed data set will be restored to the original form by the terminal device having received the data set. In one implementation, certain data may be attached to any of the above-mentioned data sets to specify a term of use of the data set so that the corresponding program can determine, from the specified term of use, whether the data set can be used at a particular time. In this case, the program data set can be prevented from being activated after a lapse of the term of use.

In each of the terminal devices 31 to 35 is stored information on the terminal device itself, i.e., user profile information (USER PROFILE). Where such user profile information is stored in the host computer 10 as well, various processes can be executed on the basis of the user profile information (USER PROFILE). FIG. 5C shows an exemplary data structure of the user profile information (USER PROFILE), which comprises user identification information (USER ID), user personal information (USER PERSONAL ID), user system information (USER SYSTEM INFO) and directory information (DIRECTORY INFO).

The user personal information (USER PERSONAL) includes a user name (USER NAME) and user address (USER ADDRESS). The user system information (USER SYSTEM INFO) includes: type data indicating a kind of the device (MACHINE KIND), such as a karaoke device, personal computer or game machine; name data identifying a name of the device by its model number (MACHINE NAME); information on the CPU used in the device (CPU INFO); memory information such as a capacity of a memory provided in the device (MEMORY INFO); information on an operating system provided in the device such as a version and type thereof (OS INFO); and information on a network protocol used in the device (PROTOCOL INFO).

The directory information (DIRECTORY INFO) includes a list of waveform data prestored in the device (WAVE LIST), and a list of tone generating programs or performance processing programs (SOFT LIST).

<Processing in Host Computer 10>

Figure 6:
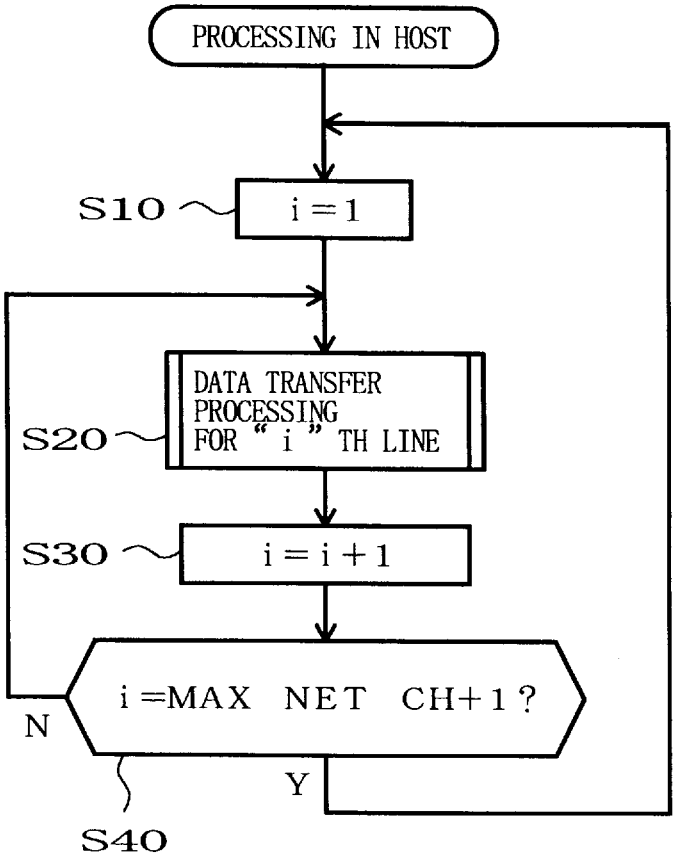
FIG. 6 is a flowchart showing an example of a main routine executed by the host computer of FIG. 1.

FIG. 6 is a flowchart showing an example of a main routine executed by the host computer 10. The host computer 10 is capable of performing line services for a maximum number of net channels MAX NET CH by time-sharing processing (TSS), so as to transmit data in response to a download request issued from any one of the terminal devices.

First, at step S10 of FIG. 6, pointer i pointing to one of the network lines to be serviced is initialized to a value of "1". Then, the host computer 10 proceeds to step S20, where data transfer processing is executed for the line pointed to by the pointer i (i.e., "i"th line). After this, the value of the pointer i is incremented by one (i+1) at step S30, and a determination is made at step S40 as to whether the current value of the pointer i has exceeded the maximum number of the channels connected to the host computer 10 (i.e., i=MAX NET CH+1). If answered in the negative (NO) at step S40, the host computer 10 loops back to step S20 in order to perform the data transfer processing for a next channel (i+1). If the current value of the pointer i has exceeded the maximum number of the channels as determined at step S40, the host computer 10 reverts to step S10, where the pointer i is again set to "1" to repeat the data transfer processing from the first channel.

Figure 7:
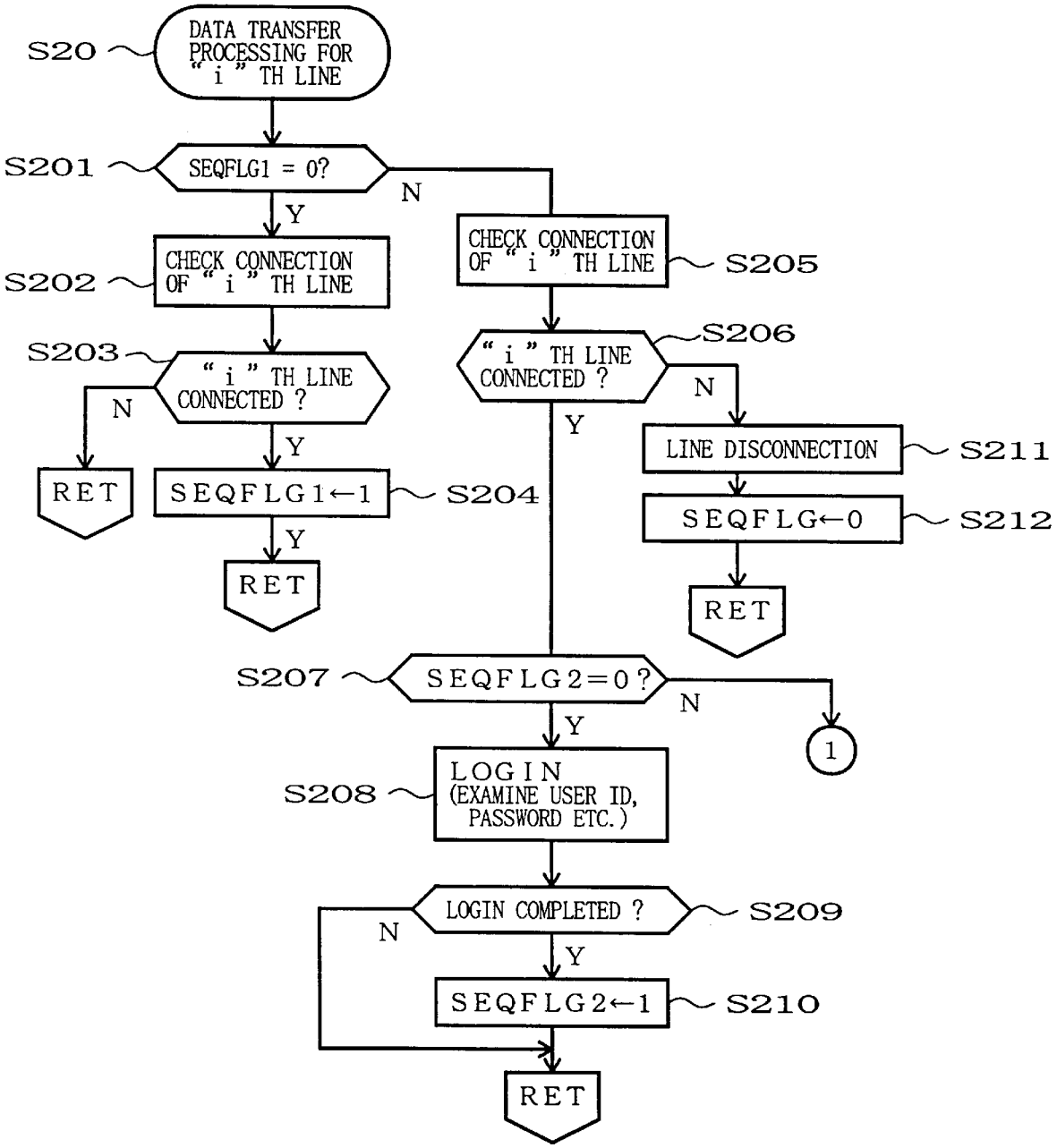
FIG. 7 is a flowchart illustrating a part of an example of a data transfer process.
Figure 8:
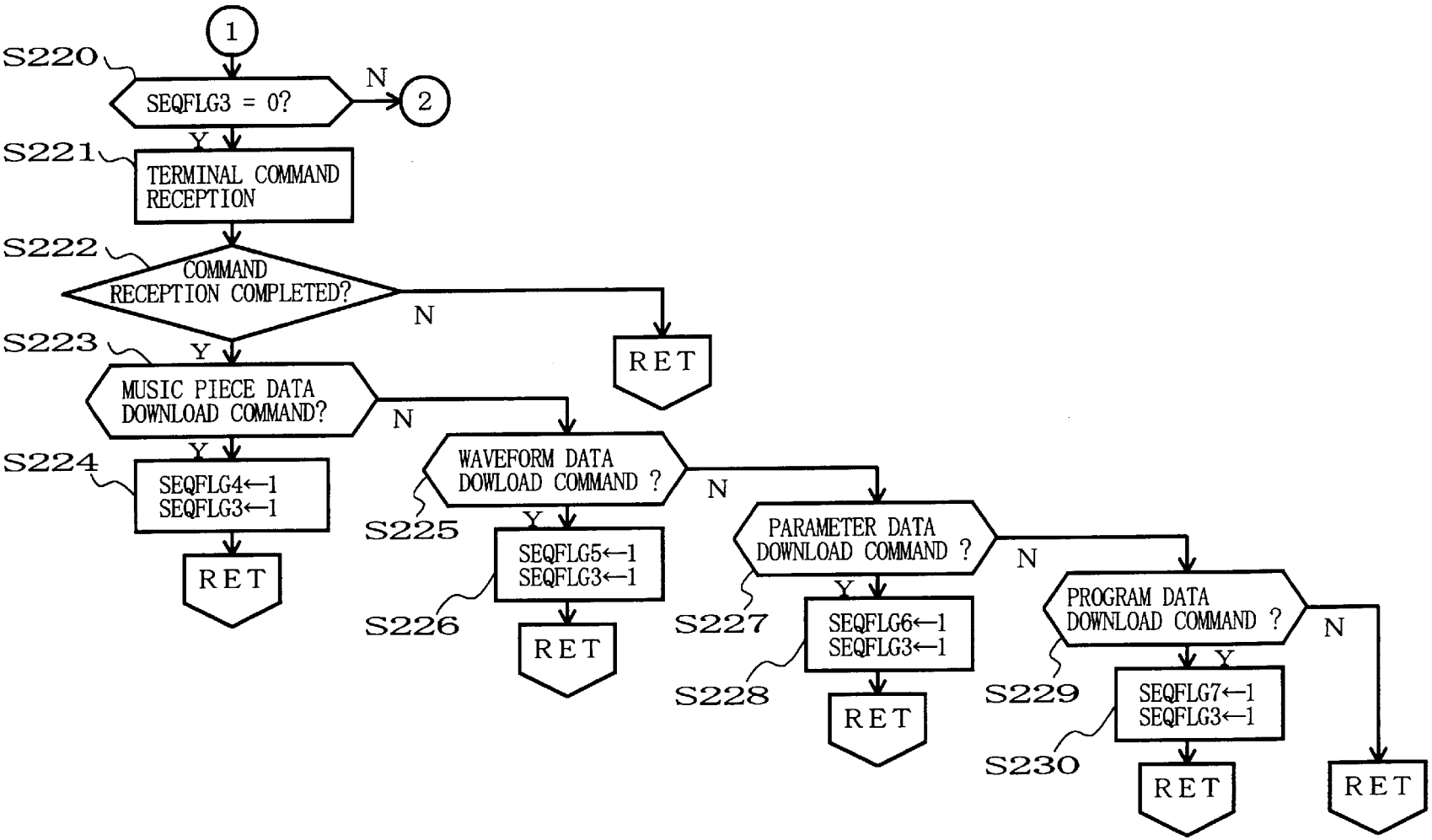
FIG. 8 is a flowchart illustrating another part of the data transfer process of FIG. 7.
Figure 9:
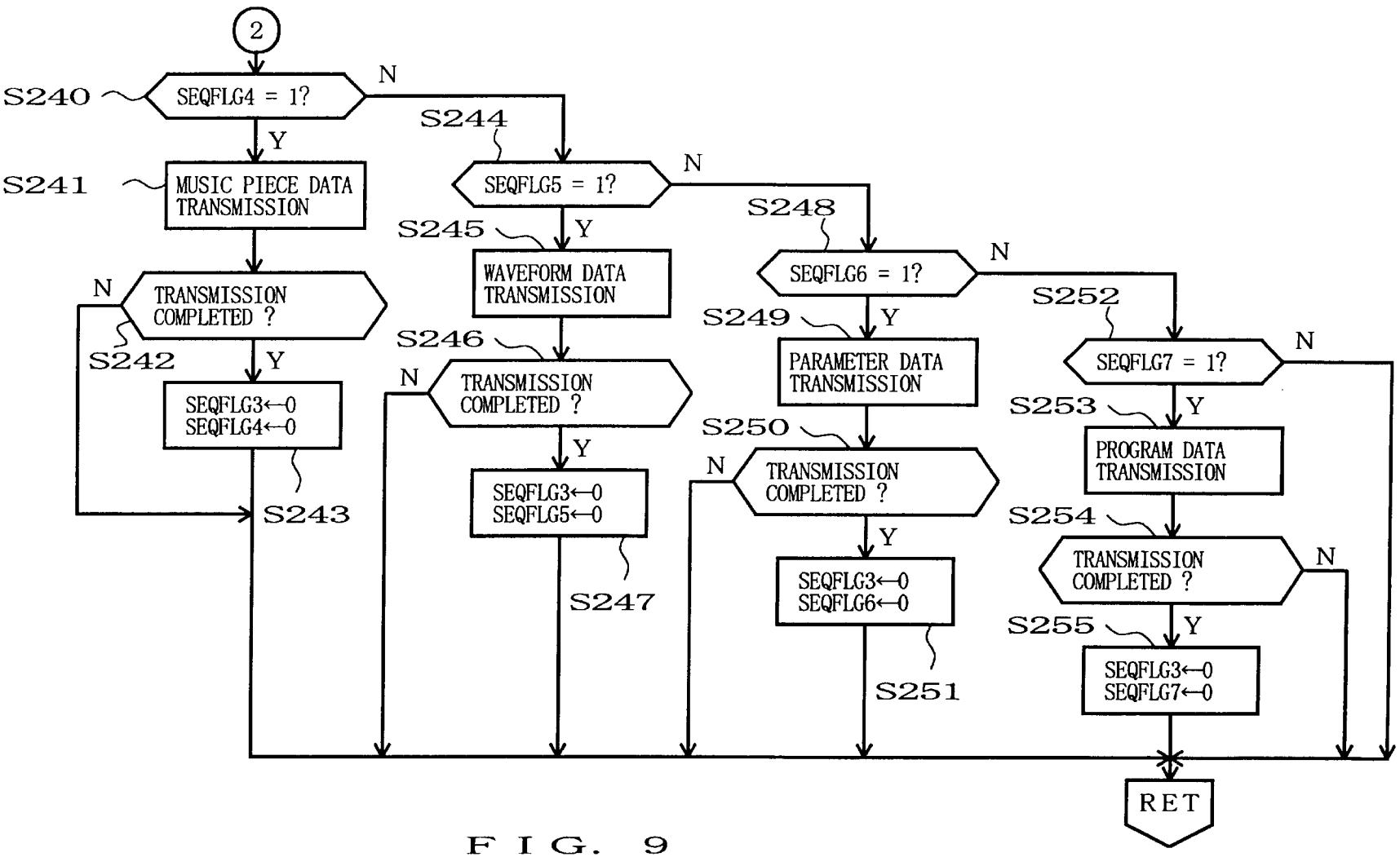
FIG. 9 is a flowchart illustrating the remaining part of the data transfer process of FIG. 7.

FIGS. 7 to 9 are flowcharts explaining details of the data transfer processing for one of the network lines pointed to by the pointer i. In this data transfer processing, a sequence of the processing is set by detecting current states of the "i"th line using seven flags SEQFLGil to SEQFLGi7. All flags SEQFLGi1 to SEQFLGi7 are initialized to a value of "0" at start-up of the information processing system, then flag SEQFLGi1 is maintained at "1" while the "i"th line is connected, and then flag SEQFLGi2 is set to "1" when a LOGIN process is completed. After this, flag SEQFLGi3 is set to "1" when a data download command is input from any one of the terminal devices, and one of flags SEQFLGi4 to SEQFLGi7 is used to indicate a type of the data requested by the data download command input.

That is, flag SEQFLGi4 is caused to indicate "1" when a music piece data download command is input; flag SEQFLGi5 is caused to indicate "1" when a waveform data download command is input; flag SEQFLGi6 is caused to indicate "1" when a parameter data download command is input; and flag SEQFLGi7 is caused to indicate "1" when a program data download command is input. In addition, when the data transfer processing responsive to the download command is completed, flag SEQFLGi3 and one of flags SEQFLGi4 to SEQFLGi7 corresponding to the transmitted data are reset to "0". In FIGS. 7 to 9 and in the following description, the letter "i" written at the end of the reference character for each of the above-mentioned flags is omitted, for simplicity.

In FIG. 7, once the data transfer processing is initiated for the "i"th line at step S20, a determination is first made at S201 as to whether flag SEQFLGl is at "0" or not. If the "i"th line is not connected such as when the system is at an initial stage, flag SEQFLGl is at "0", and thus an affirmative determination results at step S201, so that the host computer 10 goes to step S202. At step S202, the host computer 10 checks a current connecting state of the "i"th line. If the "i"th line is not connected as determined at step S203, the host computer 10 returns to step S30 of the main routine of FIG. 6 in order to perform the operations for a next line. If the "i"th line is connected and hence an affirmative (YES) determination results at step S203, the host computer 10 goes to step S204 to set "1" into flag SEQFLG1, terminate the processing for the "i"th line and then returns to the main routine of FIG. 6.

When the data transfer processing is initiated for the "i"th line at step S20 in a next cycle, a negative (NO) determination results at step S201 now that flag SEQFLG1 is set to "1" at the last execution of step S204. Therefore, the host computer 10 checks a current connecting state of the "i"th line at step S205. If the "i"th line is connected as determined at step S206, the host computer 10 proceeds to step S207. Once the determination becomes negative at step S206 due to a user's LOGOUT command or compulsory disconnection command issued by the system, a line disconnection process is executed at step S211, all of flags SEQFLG1 to SEQFLG7 are reset to "0" at step S212, and the data transfer processing for the "i"th line is terminated.

Once the determination becomes affirmative at step S206, the host computer 10 proceeds to step S207, where a further determination is made as to whether flag SEQFLG2 is at "0" or not. Because only flag SEQFLG1 is now set at "1" due to the last execution of step S204 with flag SEQFLG2 still being at "0", an affirmative determination results at step S207, so that the host computer 10 moves on to step S208 in order to perform a LOGIN process. In the LOGIN process of step S208, the host computer 10 accesses the user net to examine the user ID, password and the like. At next step S209, a determination is made as to whether the LOGIN process has been completed or not. If the LOGIN process has been completed, flag SEQFLG2 is set to "1" at step S210, and the data transfer processing S20 is terminated for the line currently pointed to by the pointer i. If the LOGIN process has not yet been completed as determined at step S209, the data transfer processing of step S20 is terminated without performing the operation of step S210.

When the LOGIN process has been completed, SEQFLG2 is set at "1" as noted earlier and thus the determination becomes negative at step S207, so that the host computer 10 moves on to step S220 of FIG. 8. At step S220, a determination is made as to whether flag SEQFLG3 is at "0". The determination becomes affirmative because flag SEQFLG3 is at "0" at this point, and hence the host computer 10 proceeds to step S221 to execute a terminal command reception process. At next step S222, a determination is made as to whether reception of a command input from the user terminal has been completed or not. When the reception of a command input from the user terminal has been completed and the determination is negative at step S222, the processing for the current line is terminated and the host computer 10 returns to the main routine of FIG. 6. Once step S222 determines that the reception of a command input from the user terminal has been completed, the host computer 10 does to step S223. Operations at and after step S223 are directed to setting any of the flags to activate or trigger a function corresponding to the received user command.

At step S223, it is determined whether the command input from the terminal device is a music piece data download command. With an affirmative determination, the host computer 10 proceeds to step S224, where flags SEQFLG3 and SEQFLG4 are set to "1" in order to terminate the processing for the "i"th line. If, on the other hand, the command input from the terminal device is not a music piece data download command, then the host computer 10 branches to step S225 to further determine whether the command input from the terminal device is a waveform data download command. If answered in the affirmative at step S225, the host computer 10 proceeds to step S226, where flags SEQFLG3 and SEQFLG5 are set to "1" in order to terminate the processing for the "i"th line.

If answered in the negative at step S225, the host computer 10 branches to step S227 to further determine whether the command input from the terminal device is a parameter data download command. With an affirmative determination, the host computer 10 proceeds to step S228, where flags SEQFLG3 and SEQFLG6 are set to "1" and the processing is terminated for the "i"th line. If, on the other hand, the command input from the terminal device is not a parameter data download command, then the host computer 10 branches to step S229 to further determine whether the command input from the terminal device is a program data download command. If answered in the affirmative at step S229, the host computer 10 proceeds to step S230, where flags SEQFLG3 and SEQFLG7 are set to "1" and the processing is terminated for the "i"th line. If answered in the negative at step S229, the processing for the "i"th line is terminated without performing the operation of step S229.

As noted above, flags SEQFLG3 and SEQFLG4 are set to "1" when the command input from the terminal device is a music piece data download command; flags SEQFLG3 and SEQFLG5 are set to "1" when the command input is a waveform data download command; flags SEQFLG3 and SEQFLG6 are set to "1" when the command input is a parameter data download command; and flags SEQFLG3 and SEQFLG7 are set to "1" when the command input is a program data download command. Namely, whenever any command is input from one of the terminal devices, flag SEQFLG3 is set to "1" and the sort of the input command is designated by one of flags SEQFLG4 to SEQFLG7.

Because flag SEQFLG3 is set at "1" after the reception of the command from any of the terminal devices is completed, the determination at step S220 becomes negative, so that the host computer 10 goes to step S240 of FIG. 9 in order to perform, at and after step S240, functions corresponding to the command input from the terminal device. At step S240, a determination is made as to whether SEQFLG4 is at "1". If answered in the affirmative at step S240, it means that the command input from the terminal device is a music piece data download command, and thus the host computer 10 goes to step S241, where the music piece data designated by the command are read out from the data bank 13 and transmitted to the terminal device connected to the "i"th line. Then, a determination is made at step S242 as to whether transmission of the designated music piece data has been completed. If the transmission has not been completed yet, the host computer 10 returns to the main routine, but if the transmission has been completed, flags SEQFLG3 and SEQFLG4 are both reset to "0" at step S243 and the current execution of the processing is terminated.

If answered in the negative at step S240, the host computer 10 branches to step S244, where a further determination is made as to whether SEQFLG5 is at "1". If answered in the affirmative at step S244, it means that the command input from the terminal device is a waveform data download command, and thus the host computer 10 goes to step S245, where the waveform data designated by the command are read out from the data bank 13 and transmitted to the terminal device. Then, a determination is made at step S246 as to whether transmission of the designated waveform data has been completed. If the transmission has not been completed yet as determined at step S246, the host computer 10 returns to the main routine, but if the transmission has been completed, flags SEQFLG3 and SEQFLG5 are both reset to "0" at step S247 to terminate the current execution of the processing.

If answered in the negative at step S244, the host computer 10 branches to step S248, where a further determination is made as to whether SEQFLG6 is at "1". If answered in the affirmative at step S248, it means that the command input from the terminal device is a parameter data download command, and thus the host computer 10 goes to step S249, where the parameter data designated by the command are read out from the data bank 13 and transmitted to the terminal device. Then, a determination is made at step S250 as to whether transmission of the designated parameter data has been completed. If the transmission has not been completed yet as determined at step S250, the host computer 10 returns to the main routine, but if the transmission has been completed, flags SEQFLG3 and SEQFLG6 are both reset at step S251 to "0" to terminate the current execution of the processing.

Finally, if answered in the negative at step S248, the host computer 10 branches to step S252, where a further determination is made as to whether SEQFLG7 is at "1". If answered in the affirmative at step S252, it means that the command input from the terminal device is a tone generating or performance processing program download command, and thus the host computer 10 goes to step S253, where the program designated by the command is read out from the data bank 13 and transmitted to the terminal device. Then, a determination is made at step S254 as to whether transmission of the designated program has been completed. If the transmission has not been completed yet, the host computer 10 returns to the main routine, but if the transmission has been completed, flags SEQFLG3 and SEQFLG7 are both reset at step S255 to "0" to terminate the current execution of the processing. If SEQFLG7 is not at "1" as determined at step S252, the current execution of the processing is also terminated.

In the above-mentioned manner, in response to the sort of the download command input from the terminal device, the corresponding data are read out from the data bank 13 for transmission to that terminal device. At the time point when the data transmission has been completed through the operations of steps S240 to S255, flags SEQFLG1 and SEQFLG2 are set at "1" and next data can be successively downloaded by receiving a download command from any of the terminal devices.

<Processing in Terminal Devices>

Figure 10:
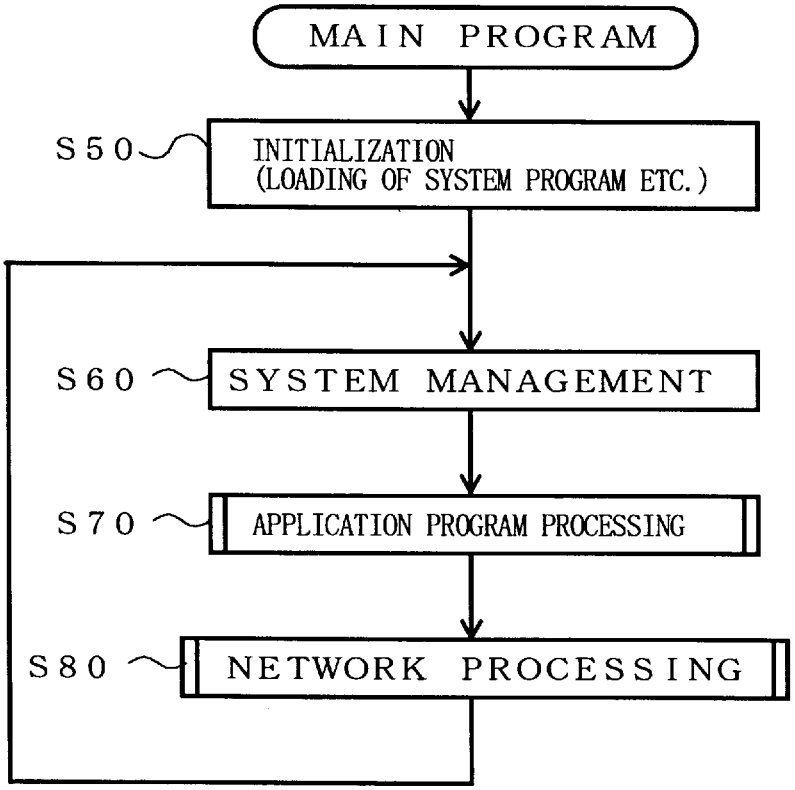
FIG. 10 is a flowchart illustrating an example of a main program executed by the terminal devices of FIG. 1.
Figure 11:
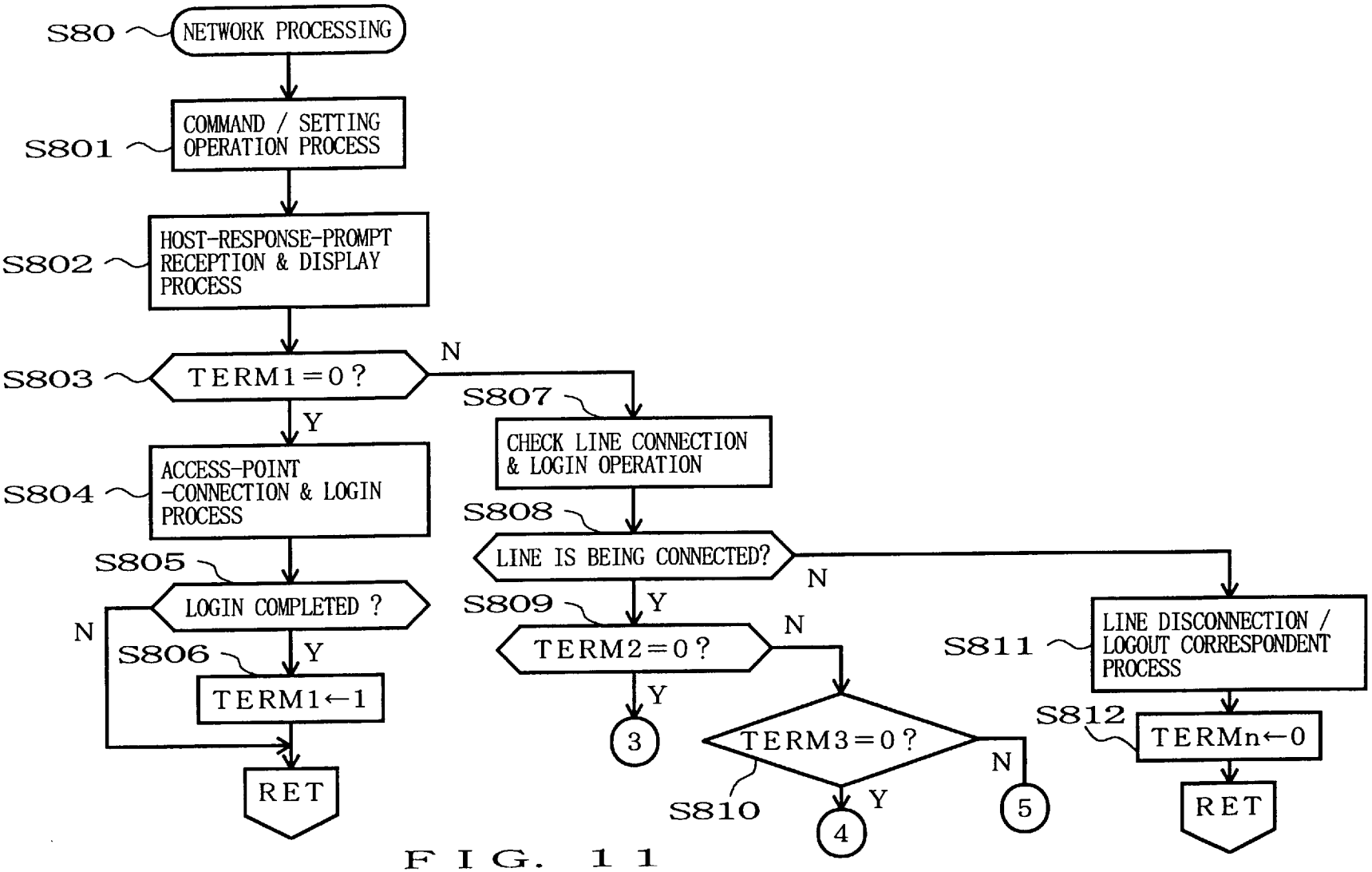
FIG. 11 is a flowchart illustrating a part of an example of network processing.
Figure 12:
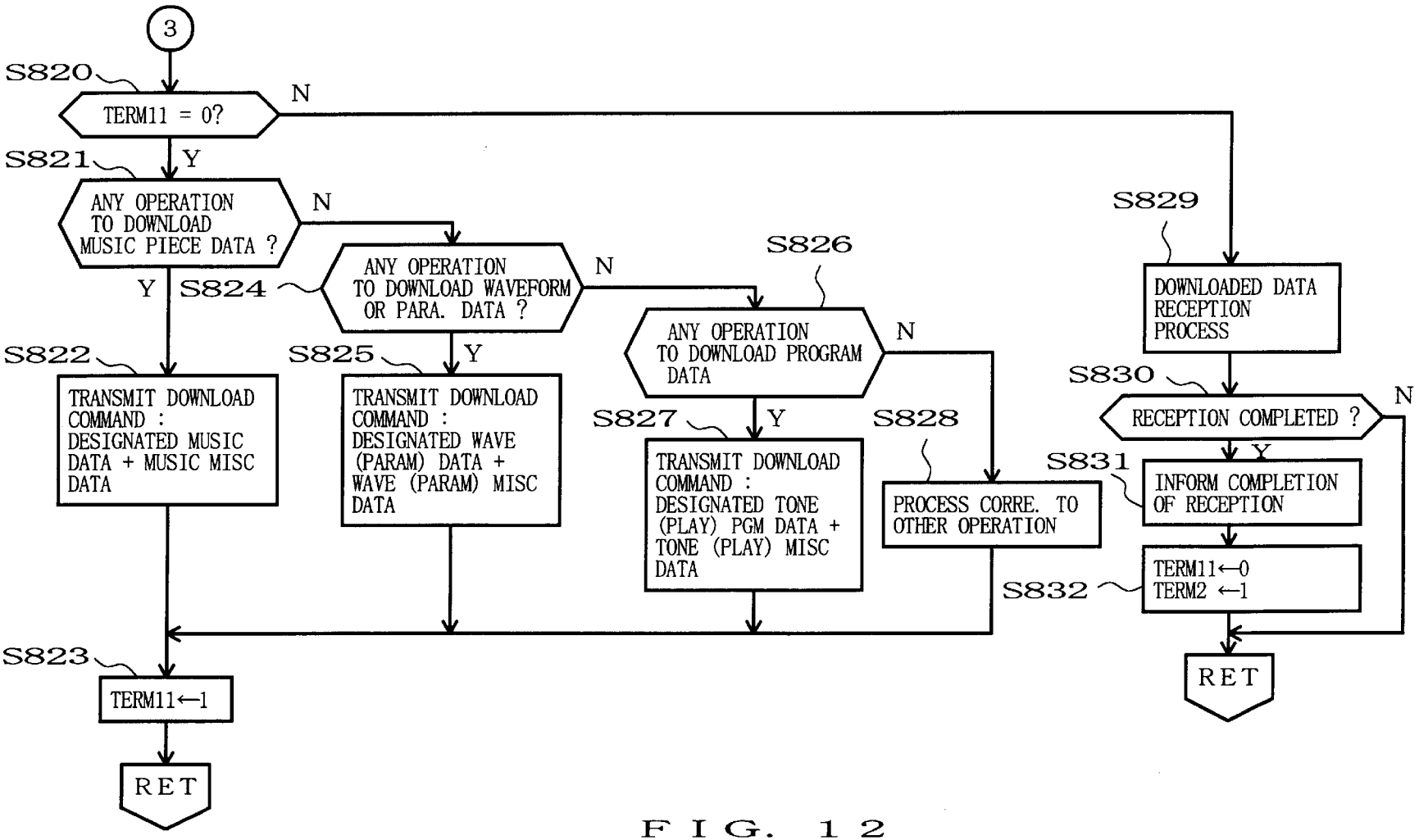
FIG. 12 is a flowchart illustrating another part of the network processing of FIG. 11.
Figure 13:
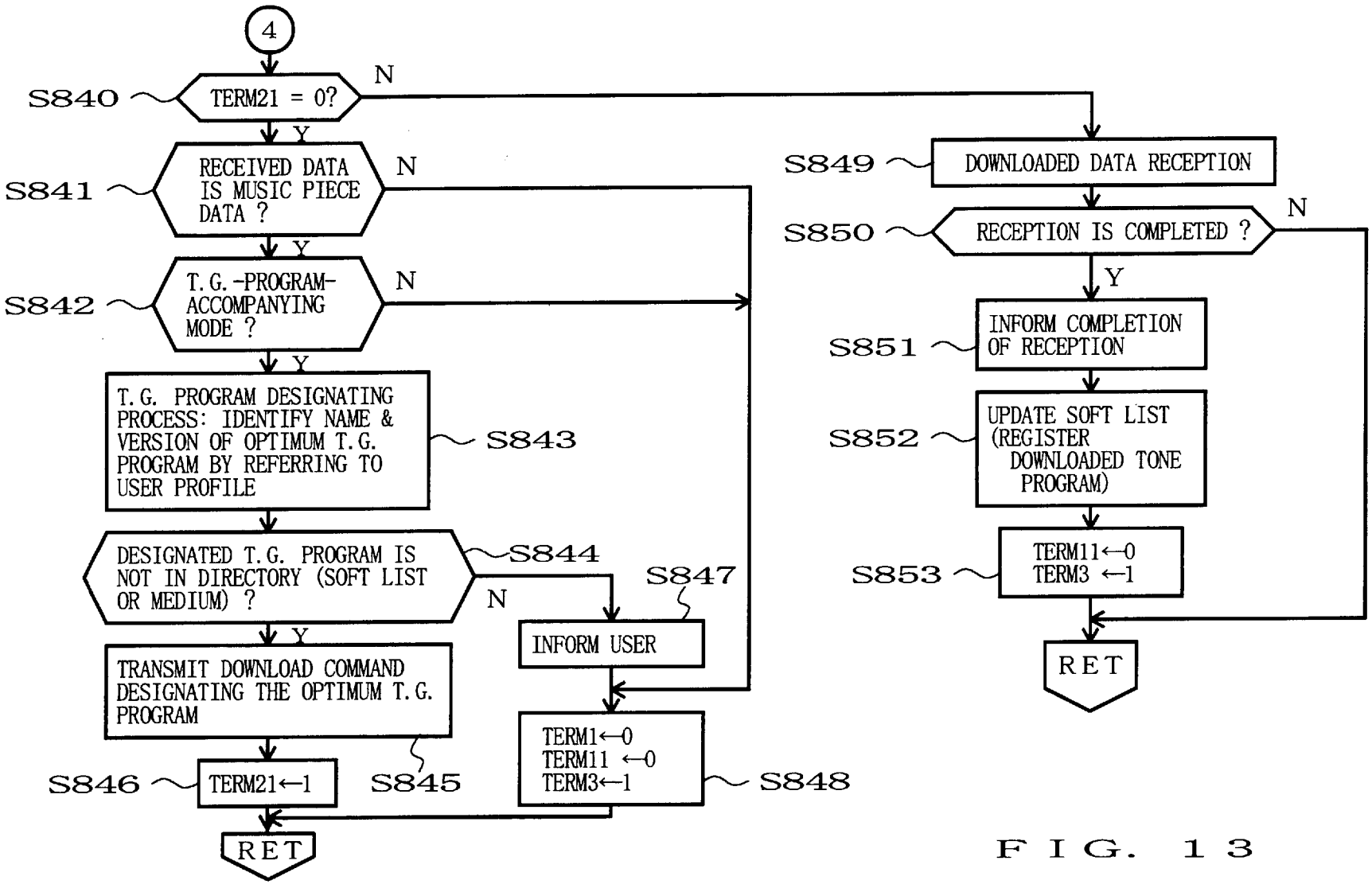
FIG. 13 is a flowchart illustrating still another part of the network processing of FIG. 11.
Figure 14:
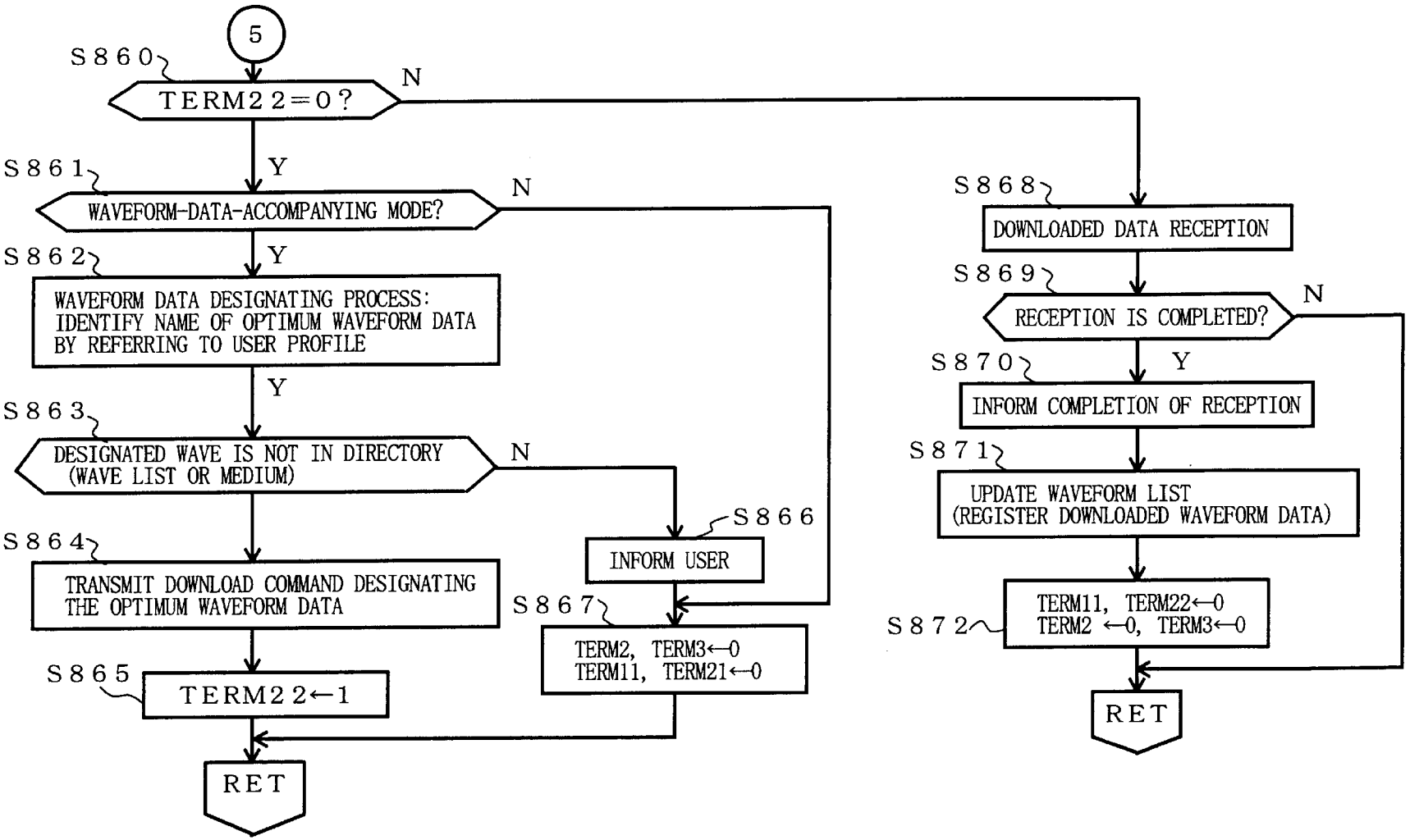
FIG. 14 is a flowchart illustrating the remaining part of the network processing of FIG. 11.

The following paragraphs describe various processing executed in the terminal devices. FIG. 10 is a flowchart of a main routine program executed by each of the terminal devices 31 to 35. As shown, an initialization process is first executed at step S50, which includes loading the system program into the terminal device. Then, a system management process is executed at step S60, and application program processing is executed at next step S70.

The term "application program" is used herein to refer to not only an ordinary application program run on a personal computer or the like, but also a program for performing predetermined operations specific to the terminal device (e.g., if the terminal device is a game machine, the application program will be game software). Depending on the nature of the system, the predetermined operations may be implemented by driver software run in combination with the operating system, and such driver software is included in the category of the "application program".

After the application program processing of step S70, network processing is executed at step S80, and then the routine loops back to step S60 to repeat the system management process of step S60, application program processing of step S70 and network processing of step S80.

<Network Processing>

The network processing of step S80 will be described in detail below with reference to FIGS. 11 to 14. The network processing is intended for connecting the terminal device to the host computer 10 and downloading data such as music piece data, waveform data, parameter data, tone generator program and performance processing program. For the music piece data downloading, two modes are provided, one of the modes being a tone-generator-program-accompanying mode in which music piece data is downloaded along with a corresponding tone generator program, the other mode being a waveform-data-accompanying mode in which music piece data is downloaded along with corresponding waveform data.

With the above-mentioned tone-generator-program-accompanying mode and waveform-data-accompanying mode, a user is allowed to automatically download an optimum tone generator program or waveform data. In the tone-generator-program-accompanying mode, a tone generator program as well as music piece data can be supplied to a user having no sound board or external tone generator connected to the network 50, so that a music piece can be performed very easily. On the other hand, in the waveform-data-accompanying mode, particular waveform data necessary for obtaining a unique musical expression of a music piece can be supplied to a user having only standard waveform data, so that a high-quality performance can be achieved with ease.

In the network processing of step S80, a sequence of the operations is controlled by use of flags TERM1–TERM3 and TERM11–TERM22 which are all reset at "0" at an initial stage.

Upon activation of the network processing, a command/setting operation process is performed at step S801 to determine a current operational state of a mouse, keyboard or operation panel operated by the user. A host-response-prompt reception and display process is executed at next step S802, and then a determination is made at step S803 as to whether flag TERM1 is currently at a value of "0". Because flag TERM1 is at "0" at the initial stage, an affirmative determination results at step S803, so that the processing proceeds to step S804 in order to execute an access-point-connection and LOGIN process.

In this case, automatic access may be made to a nearest access point or to an access point requiring a lowest line cost. In downloading data, a currently-connected access point may be used as a data selecting criterion. For example, where the access is being through a long-distance call, a version of a same music piece or program having a lowest data amount may be automatically selected for downloading.

After step S804, the processing moves on to step S805 in order to determine whether the LOGIN process has been completed. If the LOGIN process has been completed, the processing terminates the network processing after setting flag TERM1 to "1" at step S806.

Once the determination becomes negative at step S803 by flag TERM1 being set to "1", the processing branches to step S807 in order to check a current line connection state and LOGOUT operation, so that it is determined whether the line is being connected at step S808. If answered in the affirmative at step S808, the processing proceeds to step S809 in order to make a further determination as to whether flag TERM2 is currently set at "0". If answered in the negative at step S810, the processing proceeds to step S810 in order to make a further determination as to whether flag TERM3 is currently set at "0". Thus, through steps S809 and S810, different subsequent operations are performed depending on current values of flags TERM2 and TERM3.

Once the determination becomes negative at step S808, the processing branches to step S811 in order to execute a line disconnection/LOGOUT correspondent process. Then, the processing terminates the network processing after resetting all the TERM flags to "0" at step S812.

At the time point when the LOGIN to the host computer 10 has been completed, flag TERM2 is still at "0", so that the determination becomes affirmative at step S809 and the processing moves on to step S820 (FIG. 12), where a determination is made as to whether flag term11 is currently at "0". Because flag term11 is at "0" at this time, the determination becomes affirmative at step S820, so that the processing proceeds to step S821, where a determination is made as to whether any input operation has been made to download music piece data. With an affirmative determination, a command for downloading the music piece data designated by the input operation is transmitted to the host computer 10 at step 822. Then, the processing terminates the network processing of step S80 after setting flag TERM11 to "1" at step S823.

If answered in the negative at step S821, the processing branches to step S824, where a determination is made as to whether any input operation has been made to download waveform data or parameter data. With a negative determination, the processing branches to step S826, where a further determination is made as to whether any input operation has been made to download program data. If answered in the negative at step S826, the processing branches to step S828 in order to execute a process corresponding to any other input operation. If any input operation has been made to download waveform data or parameter data as determined at step S824, a command for downloading the waveform data or parameter data designated by the input operation is transmitted to the host computer 10 at step S825. If any input operation has been made to download program data as determined at step S826, a command for downloading the tone generating program or performance processing program designated by the input operation is transmitted to the host computer 10 at step S827. After these operations, the processing terminates the network processing of step S80 after setting flag TERM11 to "1" at step S823.

Once the determination becomes negative at step S820 by flag TERM11 being set to "1", the processing branches to step S829 in order to execute a downloaded data reception process. After this, the processing proceeds to step S830, where a determination is made as to whether reception of the downloaded data has been completed. If answered in the affirmative at step S830, the processing goes to step S831 to inform the user that the reception has been completed. Then, flag TERM11 is reset to "0" and flag TERM2 is set to "1" at step S832 before the processing terminates the current execution of the network processing. If the reception of the downloaded data has not been completed as determined at step S830, the processing terminates the network processing without performing the operations of steps S831 and S832.

Once the determination becomes negative at step S809 by flag TERM2 being set to "1", the processing branches to step S810 in order to check a current state of flag TERM3. If an affirmative determination results at step S810 with flag TERM3 set at "0", the processing moves on to step S840 (FIG. 13) in order to check a current state of flag TERM21. If flag TERM 21 is currently at "0", the processing goes to step S841 in order to determine whether or not the received data is music piece data. If the received data is other than music piece data, then the processing jumps to step S848 to reset flags TERM1 and TERM11 to "0" and set flag TERM3 to "1" and then terminates the current execution of the network processing.

If the received data is music piece data as determined at step S841, the processing goes to step S842, where a determination is made as to whether or not the current download process is in the tone-generator-program-accompanying mode. With a negative determination, the processing terminates the network processing of step S80 after performing the operation of step S848 as in the case where other data than music piece data is downloaded.

If the current download process is in the tone-generator-program-accompanying mode as determined at step S842, the processing proceeds to step S843 in order to execute a tone generator program (TONE PGM) designating process. This designating process identifies the name and version number of an optimum tone generator program by referring to user profile information (USER PROFILE) in accordance with corresponding tone generator (program) information (TG INFO) contained in music-piece-related data (MUSIC MISC DATA) of the received music piece data, so that the optimum tone generator program is designated as a candidate for downloading.

As the optimum tone generator program, a selection is made of one of those programs which is compatible with the CPU, personal computer and operating system and which also meets conditions of:

(1) not requiring more than the user memory capacity or requiring a smallest memory size among the programs;

(2) being capable of generating tones that satisfy tonal quality desired by the user;

(3) being of latest version if there exist a plurality of tone generator programs satisfying the above-mentioned conditions, etc.

After having identified the name and version of the optimum tone generator program in this manner, the processing proceeds to step S844, where a list of software being loaded into the terminal device (specifically, the software list in the directory information of the user profile information shown in FIG. 5C) or directory of media incorporated in the terminal device is examined in order to determine whether or not the selected or designated optimum tone generator program is not stored in the terminal device. If the tone generator program is not stored in the terminal device, then the processing proceeds to step S845 to transmit a download command designating the selected optimum tone generator program. Then, the processing terminates the current execution of the network processing after setting flag TERM 2 to "1" at next step S846. If, on the other hand, the software list or media list shows that the selected optimum tone generator program is stored in the terminal device, the processing goes to step S847 to so inform the user. Then, the processing terminates the current execution of the network processing after resetting flags TERM1 and TERM11 to "0" and setting flag TERM3 to "1" at next step S848.

Once the determination becomes negative at step S840 by flag TERM21 being set to "1", the processing branches to step S849 in order to execute a downloaded data reception process. After this, the processing proceeds to step S850, where a determination is made as to whether reception of the downloaded data has been completed. If answered in the affirmative at step S850, the processing goes to step S851 to inform the user that the reception has been completed. At next step S852, the software list (SOFT LIST) in the directory information is updated at step S852 to register the downloaded tone generator program (TONE PGM). Then, the processing terminates the current execution of the network processing after resetting flag TERM11 to "0" and setting flag TERM3 to "1" at next step S853.

The downloading of the tone generator program is effected in the above-described manner. However, such downloading of the tone generator program may be omitted in the case where the user system has installed therein the optimum tone generator program or similar or up-versioned program which is generally equivalent or superior to the optimum tone generator program, or a hardware tone generator which is functionally equivalent or superior to that program. Determination as to whether the loading corresponding to the system state should be effected or not, or a selection of a program or data to be loaded may be made only after performing such an environmental check in detail. Further, in the case where program data of different versions which have a same name are stored in the host computer, the latest or newest version may be automatically selected. Also, data designating a tone generator program to be used may be inserted in performance data of loaded music piece data or a data block of a performance part, so as to select the tone generator program for loading by checking the designating data. Furthermore, a so-called "auto. pilot" function may be incorporated to allow the processing to be automatically carried out in a predetermined sequence.

When flags TERM2 and TERM3 are both at "1", a negative determination results at step S810, so that the processing moves on to step S860, where a determination is made as to whether flag TERM22 is currently at "0". If answered in the affirmative at step S860, it is further determined at step S861 whether or not the current process is in the waveform-data-accompanying mode. If so, the processing proceeds to step S862 in order to execute a waveform (WAVE DATA) designating process. This designating process identifies the name of optimum waveform data by referring to the user profile information (USER PROFILE) in accordance with the tone color list contained in music-piece-related data (MUSIC MISC DATA) of the received music piece data. The optimum waveform data is selected in accordance with generally the same conditions as mentioned earlier in connection with the optimum tone generator program.

After having identified the name of the optimum waveform data in this manner, the processing proceeds to step S863, where a determination is made as to whether the optimum waveform data is not registered in the directory of the waveform list or recording medium of the terminal device. If the waveform data is not stored in the terminal device, an affirmative determination results at step S863, and then the processing proceeds to step S864 to transmit a download command designating the optimum waveform data. Then, the processing terminates the current execution of the network processing of step S80 after setting flag TERM 22 to "1" at next step S865.

If, on the other hand, the waveform list or medium directory shows that the optimum waveform data is stored in the terminal device as determined at step S863, the processing goes to step S866 to so inform the user. Then, the processing terminates the current execution of the network processing after resetting flags TERM2, TERM3, TERM11 and TERM21 to "0" at next step S867.

If the current process is not in the waveform-data-accompanying mode as determined at step S861, the processing jumps to step S867 to reset flags TERM2, TERM3, TERM11 and TERM22 to "0" and terminates the current execution of the network processing.

Once the determination becomes negative at step S860 by flag TERM22 being set to "1", the processing branches to step S868 in order to execute a downloaded data reception process. After this, the processing proceeds to step S869, where a determination is made as to whether reception of the downloaded data has been completed. If answered in the affirmative at step S869, the processing goes to step S870 to inform the user that the reception has been completed. At next step S871, the waveform list (WAVE LIST) in the directory is updated at step S871 to register the received waveform data. Then, the processing terminates the current execution of the network processing of step S80 after resetting flags TERM2, TERM3, TERM11 and TERM21 to "0" at next step S872. If reception of the downloaded data has not been completed as determined at step S869, the processing terminates the current execution of the network processing without performing the operations of steps S870, S871 and S872.

<Application Processing>

Figure 15:
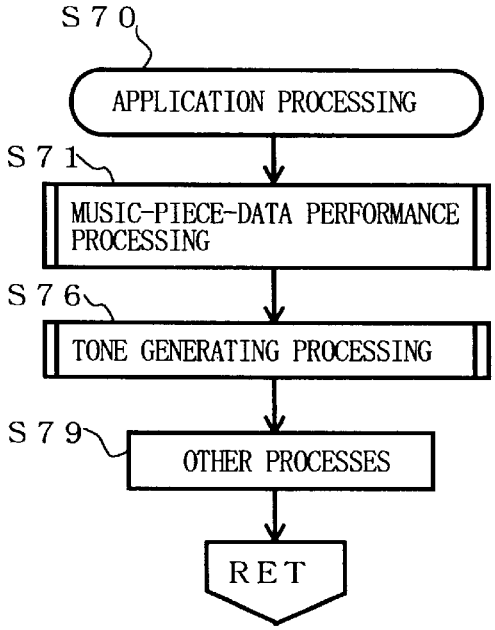
FIG. 15 is a flowchart illustrating an example of application processing.

FIG. 15 is a flowchart of the application processing executed at step S70 in each of the terminal devices, in which music-piece-data performance processing is first executed at step S71, then tone generating processing is executed at step S76, and then other processing is executed at step S79. In the other processing of step S79, other processes than the music-piece-data performance and tone generating processing are carried out depending on the type and specifications of the terminal device; if the terminal device is a game machine, other processes including those for the game itself may be carried out.

<Music-Piece-Data Performance Processing>

Figure 16:
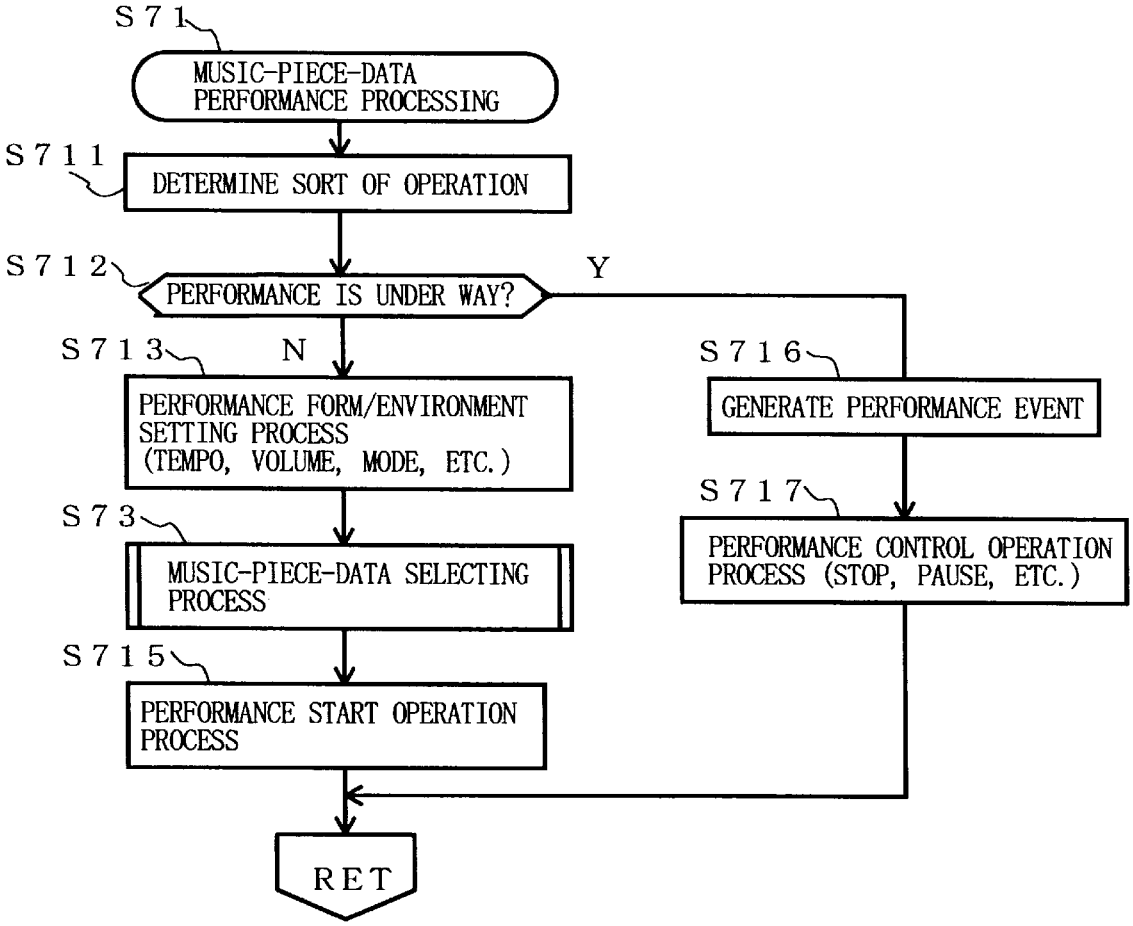
FIG. 16 is a flowchart illustrating an example of music-piece-data performance processing.

FIG. 16 is a flowchart of the music-piece-data performance processing, where an operation detecting process is first executed at step S711 to determine what sort of operation has been conducted by the user. Then, a determination is made at step S712 as to whether any performance is currently under way. If no performance is currently under way at determined at step S712, the processing proceeds to step S713 to execute a performance form/environment setting process, which sets various performance conditions such as a tempo, tone volume and mode of a performance. Following this, a music-piece-data selecting process is executed at step S73 to select and load music piece data. A performance start operation process is executed at next step S715, and then this music-piece-data performance processing is terminated.

If answered in the affirmative at determined at step S712, a performance event generating process is executed at step S716, where the music piece data loaded in the music-piece-data selecting process at step S73 is sequentially read out to generate a performance event, such as a MIDI event, at predetermined timing on the basis of the read-out data. On the basis of the generated performance event, the tone generator 113 of FIG. 3 will be controlled by the later-described tone generating processing of step S76 to generate a tone. Following the performance event generating process of step S716, a performance control operation process is executed at step S717 to carry out operations corresponding to an user input such as STOP or PAUSE. After this, this music-piece-data performance processing is terminated.

Figure 17:
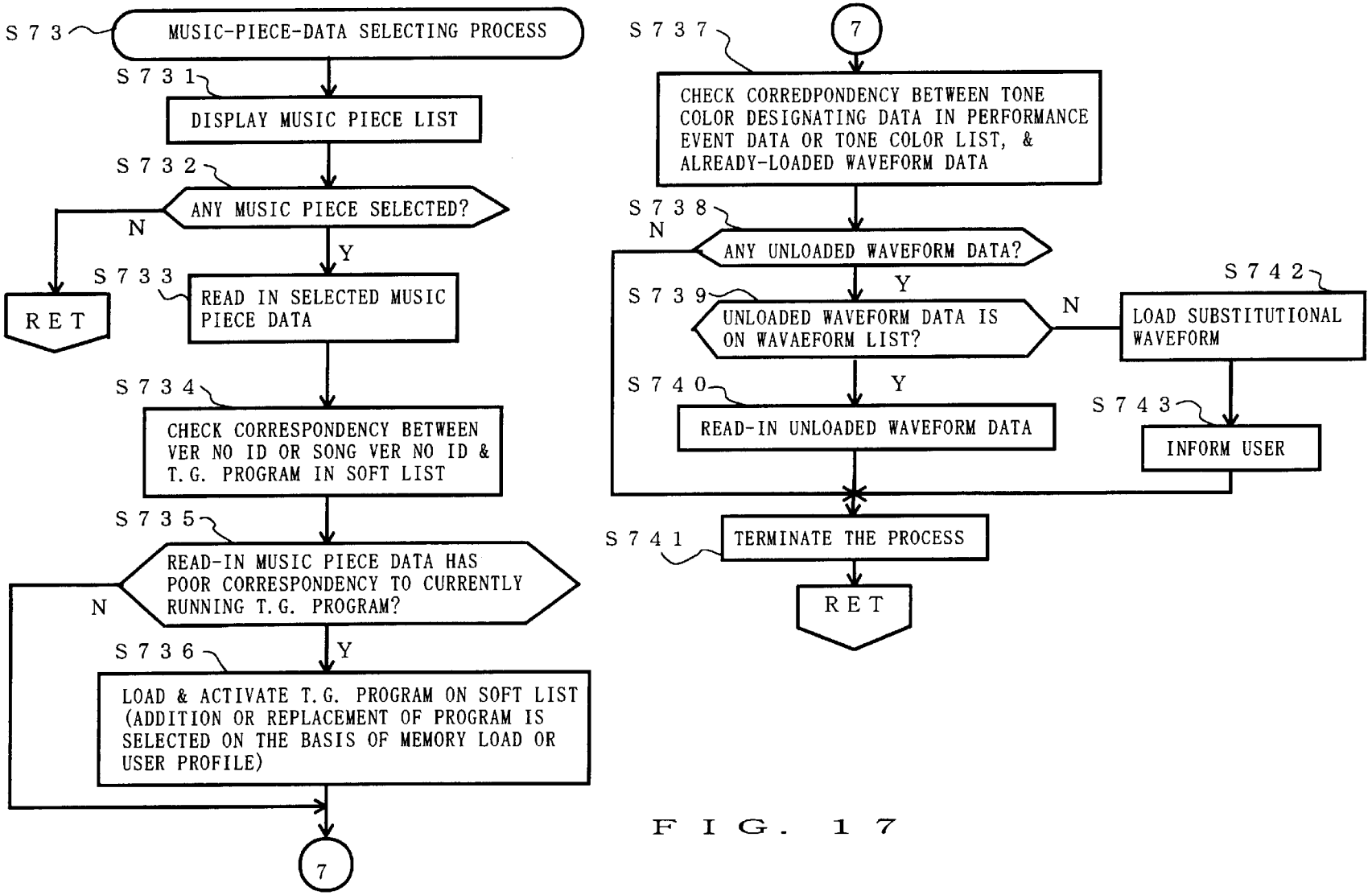
FIG. 17 is a flowchart illustrating an example of a music-piece-data selecting process.

Details of the music-piece-data selecting process of step S73 will be described with reference to FIG. 17. First, at step S731, a music piece list is displayed and the process waits until the user selects a music piece from the displayed list. A determination is made at step S732 whether any music piece has been selected by the user. If no music piece has been selected, this music-piece-data selecting process is terminated without executing other operations. If any one music piece has been selected as determined at step S732, data of the selected or designated music piece (MUSIC DATA) is read in. Then, at step S734, the process checks correspondence between version number data (VER NO ID or SONG VER NO ID) and tone generator information (TG INFO) contained in the read-in music piece data, and versions etc. of tone generator programs (TONE PGM) presented on the software list (SOFT LIST). Then, at step S735, it is determined whether the read-in music piece data has poor correspondence to the currently running tone generator program.

If an affirmative determination results at step S735 because no good correspondence is found in the version number or the like, the process proceeds to step S736, where the corresponding tone generator program on the software list (SOFT LIST) is loaded and activated. At this point, depending on the current memory load or contents of the user profile, a selection is made as to whether the program should be loaded in addition to or in place of the currently running tone generator program. After step S736, the process moves on to step S737. If a negative determination results at step S735 because good correspondence is found, the process goes directly to step S737 without performing the operation of step S736.

At step S737, it is ascertained whether good correspondence exists between the content of tone color designating data in the performance event data or tone color list (TONE COLOR LIST), and the already-loaded waveform data (WAVE DATA). Then, a determination is made at step S738 as to whether there is any unloaded waveform data. If answered in the negative at step S738, the process goes to step S741 for a music-piece-selection terminating process, and thus, this music-piece-data selecting process is brought to an end. If answered in the affirmative at step S738, the process goes to next step S739 in order to determine whether the unloaded waveform data is on the waveform list (WAVE LIST). If so, the process proceeds to step S740 to read in the unloaded waveform data and then executes the music-piece-selection terminating process of step S741.

If the unloaded waveform data is not on the waveform list (WAVE LIST) as determined at step S739, substitutional waveform data is loaded at step S742. For example, where five different piano tone colors PIANO1 to PIANO5 are selectable and if the music piece in question uses PIANO3 with only PIANO1 installed in the terminal device, PIANO1 will be loaded to be used in place of PIANO3. Then, after the loading of the substitutional waveform data is informed to the user at step S743, the process goes to the music-piece-selection terminating process of step S741 to terminate the process and display the read-in waveform data.

<Tone Generating Processing>

The tone generating processing of step S76 is intended for generating a tone by controlling the tone generator on the basis of a performance event, such as a MIDI event, generated at predetermined timing through the above-described performance event generating process of step S716. The tone generating processing will be described here in relation to an example where waveform data is arithmetically generated by software using only the D/A converter of the coder/detector (CODEC) as the tone generator 113. If a sound board or external tone generator is connected as the tone generator 113, the tone generating processing will be executed by conventional driver software.

In the case where waveform data is arithmetically generated by software, various storage areas are provided in the RAM 103 as registers for 16 kinds of tone color data PD1 to PD16 and n kinds of waveform data WD1 to WDn, channel registers for 32 channels CH1 to CH32, and a plurality of output buffers.

Each of the tone color data PD1–PD16 is comprised of data designating a waveform of a given pitch range (pitch range waveform designating data); data for controlling a low frequency oscillator (LFO) to be used for imparting vibrato effect or the like (LFO controlling data OD); data for controlling generation of a filter envelope to time-vary a tone color filter characteristic (FEG controlling data OD); data for controlling generation of a tone volume envelope to control a tone volume variation characteristic (AEG controlling data OD); touch controlling data for varying a rising speed of tone or the like in accordance with a detected key-touch velocity (touch controlling data OD); and other data including waveform-sample-forming-resolution controlling data (other data OD). "OD" attached at the end of each of the above-mentioned data stands for "original data" before being subjected to control such as modulation. In the embodiment, tone forming data to be used in the tone generator are formed by processing these original data in accordance with touch data, pitch data, etc. generated in response to a tone generating instruction.

Further, any one of the waveform data WD1–WDn is designated by the pitch range waveform designating data of one of the tone color data PD1–PD16 in accordance with input tone pitch data.

Each of the channel register areas stores a plurality of tone-generation controlling data, which include a note number, waveform designating data, LFO controlling data, filter envelope controlling data (FEG controlling data), amplitude envelope controlling data (AEG controlling data), note-on data and other data, as well as a working area to be used by the CPU 101 during execution of a program. The waveform designating data, LFO controlling data, FEG controlling data and AEG controlling data in the channel register area are tone forming data obtained by processing the respective original data mentioned above and each of these data will hereinafter be referred to with a letter "D" attached at its end.

The output buffer areas are used in turn as tone waveform forming output buffers X. Each time tone waveform sample data for the individual tone generating channels SD1, SD2, SD3, . . . are formed by arithmetic operations as will be later described, these data are accumulated channel by channel and the resultant accumulated data are stored into the output buffers. Two or more of these output buffers are designated as the tone waveform forming output buffers X and used in the waveform calculating operations. In the simplest form, two output buffers X may be used to provide a double-buffer structure such that while the data stored in one of the buffers X is being reproduced by a waveform reproduction section, new waveform sample data obtained through the waveform forming operations is stored into the other buffer X.

The output buffers may have any optional size such as 100 words, 500 words, 1K words or 5K words. In is known in the art that the larger output buffer size would result in a greater time delay in generating a tone, while the smaller output buffer size would result in a reduced time margin and poor response at the time of a temporary increase in amounts of calculation to be made. But, in cases like the present invention where a sequencer-based performance or automatic performance is executed without requiring real-time processing capability, the output buffer size may be made large because the tone generating delay can be effectively adjusted by bringing forward the performance timing.

On the other hand, where the tone generating program is used in a keyboard performance or the like requiring real-time performance capability, it is suitable that the output buffer size be in a range of 100 to 200 words in order to prevent a tone generating delay. Such an output buffer size is suitable for a reproduction sampling frequency of 40 to 50 kHz, but with a lower sampling frequency, the output buffer size needs to be much smaller.

In the tone generating processing of step S76 executed using the above-mentioned various data, the CPU 101 of the terminal device operates to arithmetically generates or forms a plurality of (e.g., 100) tone waveform samples, for each of the tone generating channels, collectively at predetermined time point. Namely, for each of the tone generating channels, tone waveform samples are generated together which correspond to 100 sampling cycles of the D/A converter.

Thus, at every predetermined calculating point, the tone generating processing is performed for all the channels.

Where the number of the generated tone waveform samples is set to "100", these samples are sequentially accumulated as a channel-specific accumulated value for 100 sampling cycles of the D/A converter and stored into the above-mentioned output buffer X. Once the sample accumulation is completed for all the tone generating channels, the tone waveform samples stored in the output buffer are read out, one sample at each sampling cycle, by the waveform reproduction section and supplied through the D/A converter to the sound system for audible reproduction or sounding. The predetermined calculating point in this embodiment is controlled to occur at intervals such that when the tone generating processing is performed by using the output buffers in turn, all the tone waveform samples can be read out and reproduced completely without being dropped or broken halfway.

With such an arrangement, preparatory operations need to be performed, for each of the channels, only once for the plural tone waveform samples to be generated collectively, and hence it is possible to reduce the proportion of an arithmetic operating or calculating time to be spent on the preparatory operations to the entire calculating time, so that overheads are reduced substantially. This can substantially enhance the quality of the generated tone waveform samples and increase the number of simultaneously generatable tones.

In addition, each time input data (in this case, MIDI event data) is received, waveform arithmetic operations or calculations are performed for samples up to the time point. At the predetermined calculating point, tone waveform sample calculations are performed only on uncalculated ones of a predetermined plurality of tone waveform samples (i.e., samples corresponding to the size of each of the output buffers X).

In the tone generating processing, where the waveform sample calculations are performed for each of the tone generating channels currently sounding tones, more arithmetic operations are required in each of the channels where there is present a key-on or key-off event involving a particular form of tone generation varying in response to input data (pitch bend or tone volume change), than in other channels where tone generation is continued with no variation responsive to the input data. In such a case, with the calculating points set to occur at fixed intervals, much of the operating period will be occupied by the channels involving a change in the form of tone generation, which eventually reduces the number of tone generating channels for which the necessary arithmetic operations can be completed within the limited time. In particular, for each of the channels where tone generation is to start, many initializing operations such as initialization of an address counter and envelope generator and generation of an "F" number are necessary, thus taking a long operating time. Therefore, by performing the tone waveform calculation collectively each time MIDI event data is input, the reduction in the number of tone generating channels can be effectively avoided.

Namely, when note-on event data is input, the note number NN and velocity VEL of the note-on event are stored into respective registers, and the occurrence time of the event is also stored into a corresponding register as time TM. Then, tone generating channel assignment is performed on the registered note number NN, and the channel number of the tone generating channel (CH) thus assigned is stored in a register as "CHi". Next, tone controlling data corresponding to the note number NN and velocity VEL is set in the channel register for the channel CHi. The thus-set tone controlling data is tone forming data D obtained by processing, in accordance with the values of the note-on number NN and velocity VEL, the data of the prestored tone color data which corresponds to the MIDI channel having received the note-on event. The waveform designating data D in the tone forming data specifies one of the waveform data WD1 to WDn, as a waveform to be used in tone generation corresponding to the note number NN.

After the tone controlling data have been set, a note-on flag for the channel CHi is set and then a tone waveform is arithmetically formed. This arithmetic formation is effected on a portion, of an entire waveform to be written into the currently available output buffer X, which has not yet been calculated and corresponds to a period before the event occurrence time TM, and the thus-calculated partial waveform is written into the output buffer X. The partial waveform is a waveform portion whose data have been fixed and hence become calculatable at the time of detection of the newly received data. Also, the partial waveform to be arithmetically formed is a waveform portion up to the occurrence time TM of the received note-on event.

When note-off event data is input, the note number NN, velocity VEL and occurrence time TM of the note-off event are stored into respective registers. Then, one of the tone generating channels (CH) sounding the note number NN is identified, and the number of the identified channel CHi is stored into the corresponding register. Following this, the note-on flag for the identified channel CHi is reset, and the tone waveform calculation is executed. In this tone waveform calculation, the uncalculated waveform portion (partial waveform) corresponding to a period prior to the time TM is calculated and written into the output buffer X in a similar manner to the above-mentioned. Also, a predetermined release process is executed for the channel CHi.

Figure 20:
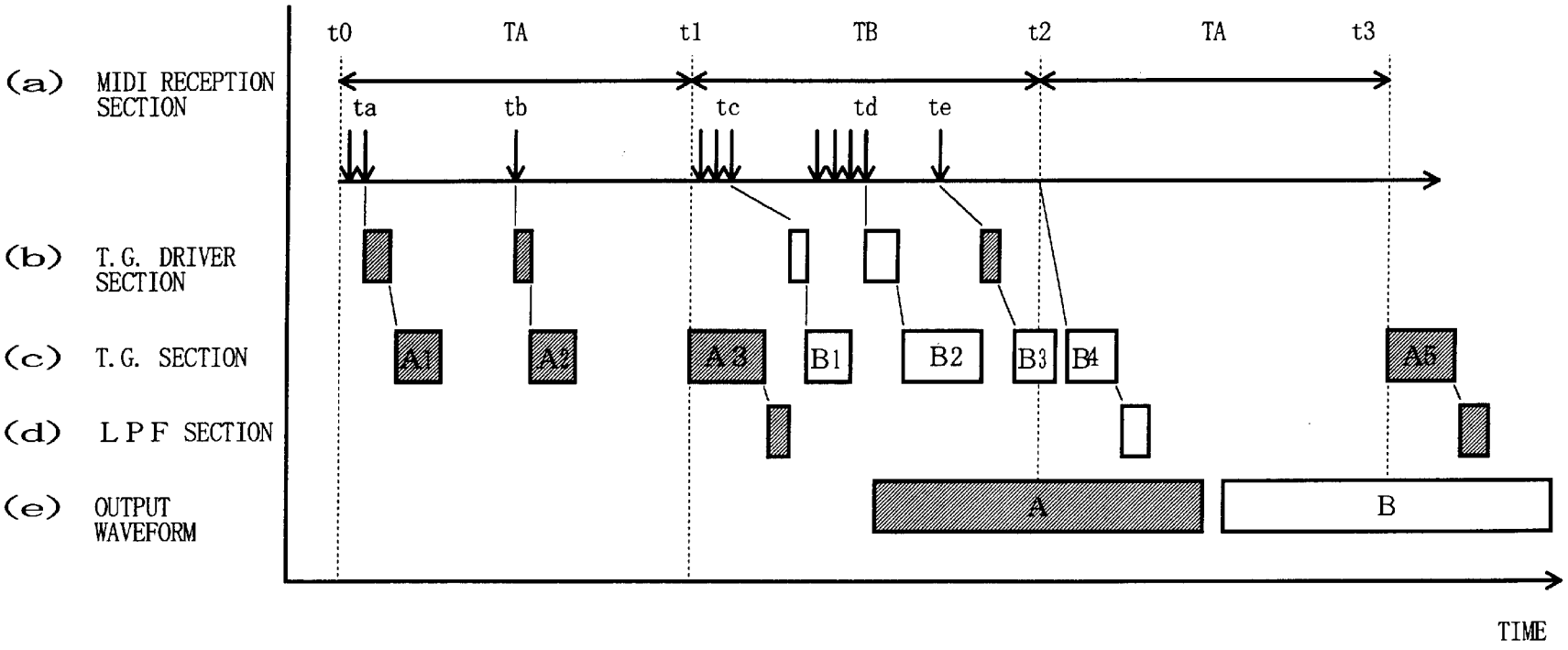
FIG. 20 is a timing chart explanatory of the tone generating processing of FIG. 18.

FIG. 20 is a timing chart explanatory of the above-described tone generating processing, where the output buffers provided as the double-buffer structure are denoted by A and B, respectively, in the figure in part (e). Times required for reproduction from the buffers A and B are shown by TA and TB, respectively, and time TA is equivalent to TB (TA=TB) in this embodiment.

First, once two MIDI events are received by a MIDI reception section at point Ta in a calculating time range from point T0 to point T1 that is allocated for the first output buffer A as shown in part (a) of FIG. 20, a tone generator (T. G.) driver section performs processing as shown in part (b), and a tone generator (T. G.) section calculates tone waveform samples A1 corresponding to the input received during a period from point t0 to point ta as shown in part (c).

The tone generator driver section receives data from the input buffer or from the personal computer keyboard, assigns the received data to one of the tone generator channels and executes a conversion from voicing parameters to tone generator parameters in accordance with the input data. Further, the tone generator section receives the tone generator parameters and processes waveform data to form tone waveform samples that are to be actually sounded. An LPF section removes aliasing noise components from the formed tone waveform sample, and output data from the LPF section is written into the first and second output buffers A and B. The above-mentioned tone generator driver, tone generator and LPF sections are functions performed by the CPU 101 executing the application program.

Then, once one MIDI event is received at point Tb, the tone generator driver section performs processing similarly to the above-mentioned, and the tone generator section calculates tone waveform samples A2 corresponding to the input received during a period from point ta to point tb. Then, upon arrival at point t1, the tone generator section calculates tone waveform samples A3 corresponding to the input received during a period from point tb to point t1. In this case, when key-on events are received at points ta and tb, tone generating initialization and arithmetic operations are performed at this point t1. After that, the LPF performs a filtering operation, and thus necessary tone waveform sample formation is completed for the first output buffer A.

Then, three new MIDI events are received at point tc in a calculating period from point t1 to point t2 that is allocated for the second output buffer B as shown in part (a) of FIG. 20. Because the tone generator section is currently calculating tone waveform samples A3, the input event data are temporarily held in the input buffer until a calculating time is allocated to the data. Upon completion of the calculations of tone waveform samples A3 by the tone generator section and the filtering operation by the LPF section, the event data are read out from the input buffer to be processed by the tone generator driver section, and thus the tone generator section calculates tone waveform samples B1 corresponding to the input received during a period from point t1 to point tc. Even if some time delay occurs in the calculating operations, it does not influence the tone generation timing because the occurrence times of the input event data have also been written in the input buffer.

After that, four new MIDI events are received during the calculations of the tone waveform samples B1, and these event data are processed to calculate corresponding tone waveform samples after the calculations of the tone waveform samples B1, similarly to the above-mentioned.

In the same manner, tone waveform samples B2 are formed as samples corresponding to the input received during a period from point tc to point td, tone waveform samples B3 are formed as samples corresponding to the input received during a period from point td to point te, and tone waveform samples B4 are formed as samples corresponding to the input received during a period from point te to point t2. Then, tone waveform samples A5 are formed as samples corresponding to the input received during a period from point t2 to point t3.

As seen from the foregoing, every time input data occurs, the processing calculates waveform samples for a period preceding the input data occurrence, and thus the waveform sample calculations can be performed in a substantially dispersed fashion. Thus, the amount of operations performed in each calculating period at predetermined intervals is limited appropriately, so that even when there occur many input data, such as key-on event data, involving a variation in the form of tone generation, it is possible to avoid inconveniences such as reduction in the number of simultaneously generatable tones.

In order to generate tones successively in the case where the calculating points are generated at predetermined intervals and a predetermined number of tone waveform samples are formed collectively in each calculating period through arithmetic operations, the predetermined number of tone waveform samples must be supplied before formation of the preceding tone waveform samples is completed. But, if the number of tone generating channels is relatively great and hence the amount of waveform calculating operations is excessive, there will arise a problem that tone waveform samples of all the channels can not be supplied in time, causing an undesirable interruption or break of generated tones.

To avoid such inconveniences, the processing of the present invention is designed to ascertain whether the predetermined number of tone waveform samples can be supplied in time for the data conversion timing of the D/A converter. If it is determined that the tone waveform samples can be supplied in time for the data conversion timing, one or more of the tone generating channels are selected whose assigned tone has a relatively low importance among all the tones being generated at the present time. Then, for the designated channel, the processing calculates, in a short time, damping waveform samples which correspond to the initial period of the waveform.

Because only the short-period damping waveform samples are calculated for the designated tone generating channel, the necessary calculating time for this channel can be reduced so that the predetermined number of tone waveform samples as a whole is supplied in time for the data conversion timing of the D/A converter.

Generally, tones that are determined as "important" in the processing are:

(1) tone currently having a great volume;

(2) tone whose attack portion has just started to be sounded;

(3) lowest-pitch tone (bass tone) when tones of two or more parts are being sounded;

(4) highest-pitch tone (lead tone) when tones of two or more parts are being sounded; and (5) tone of a solo part when tones of two or more parts are being sounded.

The tone generating channels may be placed in descending order of importance of tones to be generated therein before the waveform sample calculations, in such a manner that the sample calculations are effected sequentially from the most important tone to the least important tone. If the waveform sample calculations for all the channels can not be completed in time, the calculations are broken off so that tones are generated only with tone waveform samples having so far been formed. Thus, in case there is a need to interrupt the sample calculations, only a tone or tones will be deadened or muffled which have a relatively low importance and hence have a relatively small influence.

In order to generate tones successively in the case where the calculating points are generated at predetermined intervals and a predetermined number of tone waveform samples are formed collectively through arithmetic operations, the predetermined number of tone waveform samples must be supplied before formation of the preceding tone waveform samples is completed. But, if the number of tone generating channels is relatively great and hence the amount of waveform calculating operations is excessive, or if the predetermined number of tone waveform samples can not be supplied in time e.g. because too much time is spent on other processing than the tone generating processing (such as sequencer processing), one or more tone waveform samples will be read out even in the course of being processed, thus resulting in unwanted noise.

This problem can be solved by the CPU 101 instructing the waveform reproduction section to send the data stored in either of the output registers. In this case, addresses in the output buffer X itself for storing the predetermined number of the formed tone waveform samples can be set in the reproduction section as one of readout sections or as a repetitive readout section from which data are to be read out repeatedly. In addition, a readout section reservation may be made in such a manner that data at the addresses can be read out immediately following a particular readout section from which data are being currently read out.

In such an arrangement, the readout section reservation allows the formed tone waveform samples to be registered in the output buffer for the reservation purpose and to be read out immediately following a specific waveform being currently read out. In the event that the calculations for the predetermined number of tone waveform samples have not been completed in time, such a reserving registration is not effected, and therefore it is possible to prevent occurrence of noise which would otherwise be caused by sounding of any of the tone waveform samples that is still in the course of being processed. This will temporarily interrupt sounding of a tone, but adverse effects resulting from the interruption will be significantly reduced by limiting the interruption time to only several sampling periods in the case where the sampling frequency is for example 44.1 kHz. The limitation of the interruption time may be effected by limiting the number of channels generating tones, as mentioned earlier. Once the calculations have been completed, the reserving registration is carried out, so that the corresponding waveform samples are sounded.

As mentioned earlier, in order to generate tones successively in the case where the calculating points are generated at predetermined intervals and a predetermined number of tone waveform samples are formed collectively through arithmetic operations, or where the waveform sample calculations are executed in response to occurrence of each input data, the predetermined number of tone waveform samples must be supplied before formation of the preceding tone waveform sample is completed.

As the calculating point for a specific tone waveform sample, such a point is designated, on the basis of a time point when formation of preceding tone waveform samples is ended (end time point of the preceding tone waveform sample), which is earlier than a prescribed end time point by the time necessary for completing formation of a waveform. Because the end time point is identified by the CPU 101 checking the current state (flag) of the reproduction section to thereby detect when the sample reproducing time section has moved onto a next one, the actual end time point will be delayed until the CPU 101 detects the change in the state (flag) of the reproduction section. Further, because this time delay depends on the timing when the CPU 101 effects the above-mentioned detection, the individual formed samples will present non-uniform delays depending on the respective detection timing.

If the calculating points are generated on the basis of such non-uniformly delayed end time point, correct calculating points can not be obtained. In particular, if the calculating points are generated on the basis of greatly delayed timing, a total time length between the calculation start and the supply of waveform data is substantially shortened, so that the number of simultaneously generatable tones is temporarily reduced.

To provide a solution to the problem, the CPU 101 prestores in memory a plurality of time points when a change in the state of the reproduction section was detected in the past, and by averaging the stored time points, the CPU 101 predicts a time point when such a change will be detected next. Since the predicted time point corresponds to an average of time delays from the prescribed end time point in the reproduction section, a point that is a predetermined time before the predicted time point can be detected as a practically correct end time point. Thus, the calculating point is generated on the basis of the correct end time point. In this way, the detected end time points are averaged to reduce non-uniformity thereof, and thus the operating period allocated for each calculating point is effectively uniformized in such a manner that tone forming operations are performed in a stabilized manner.

The waveform sample calculations may be performed collectively for each time section, rather than in response to occurrence of each input data. In such a case, a trigger signal may preferably be generated to bring forward the calculating point in accordance with the number of input data. In another modification, each time section between the predetermined calculating points may be divided into "n" equal parts so that the waveform forming calculation process is performed at intervals corresponding to the "n" parts, and a reserving registration may be made for sounding of tone waveform samples for one time section that have been completely formed in the last or "n"th calculation.

Figure 18:
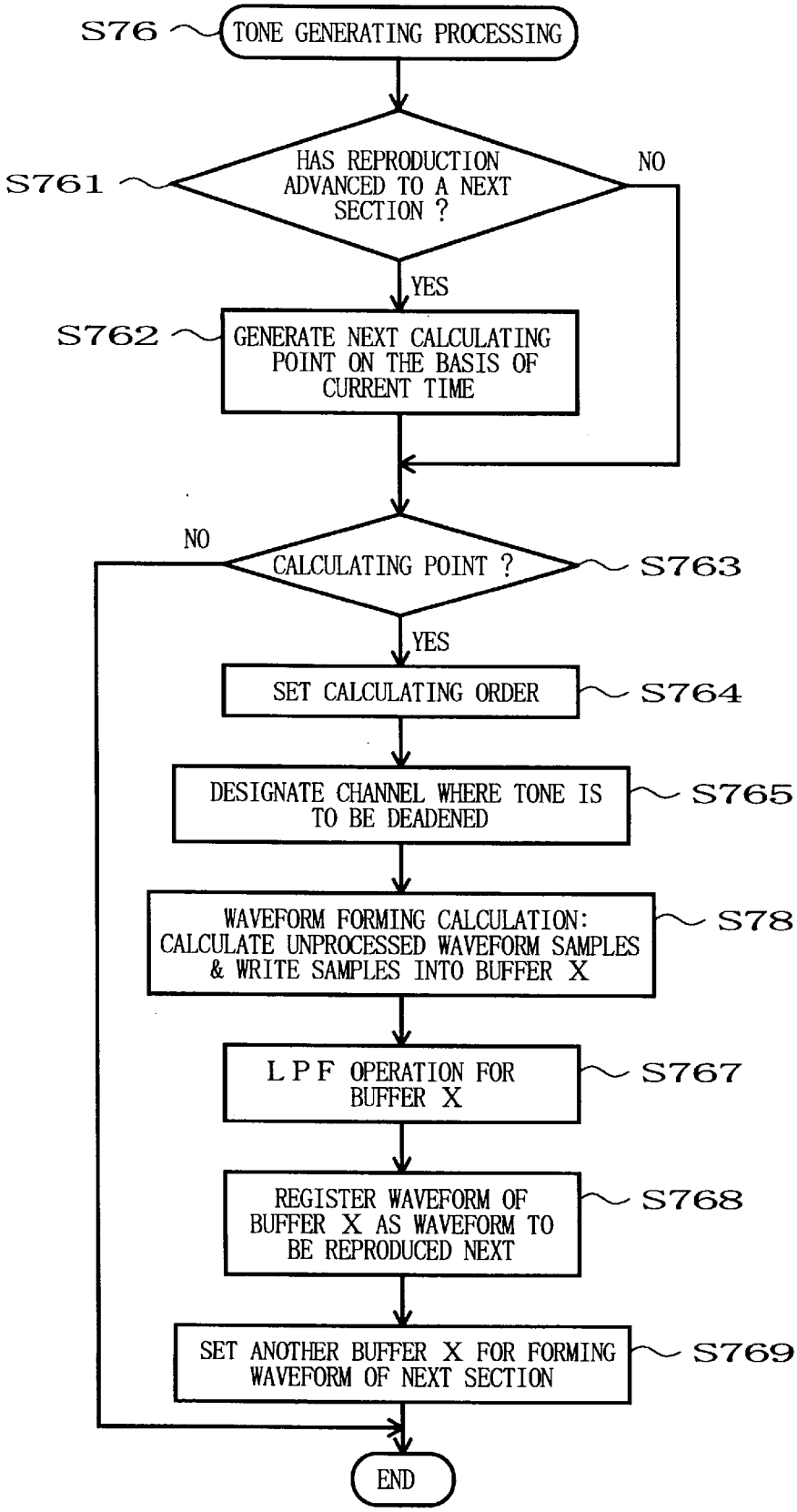
FIG. 18 is a flowchart illustrating an example of tone generating processing.

The essential operation of the tone generating processing will be described in detail hereinbelow with reference to flowcharts of FIGS. 18 and 19.

First, the reproducing state of the reproduction section is checked at step S761. If the reproduction section has advanced to a next to-be-reproduced section, the processing goes to next step S762, but if not, the processing jumps to step S763.

The waveform reproduction section reads out waveform samples one by one, at a predetermined sampling frequency, from a specific one of the areas of the RAM 103 designated by the CPU 101, and supplies the read-out samples to the D/A converter for audible reproduction. While reading the waveform samples from the designated area, the waveform reproduction section accepts a reservation from the CPU 101 designating another area to be reproduced. Once reproduction of the preceding area has been completed, waveform samples of the next area thus reserved are similarly read out one by one by the reproduction section and supplied to the D/A converter for audible reproduction. The advancement of the reproduction section to the next to-be-reproduced section means herein that after completion of the reproduction of a specific area designated last as the to-be-reproduced section, the reproduction section has moved to another specific area reserved as a next to-be-reproduced section. In this case, a plurality of the specific areas of the RAM can be reserved at one time and are reproduced in the order in which they were reserved.

Then, at step S762, time when such an advancement will be detected next (next advancement detection time) is predicted on the basis of the time of the current and previous advancement detections, and a time point that is a predetermined time before the predicted detection time is designated as a next calculating point. The next advancement detection time may be predicted such as by calculating an approximate value with a small error through the "least squares method" on the basis of a plurality of the advancement detection times including the current and last ones, or by using a quadratic function or the like to approximate a variation in the detection times. Non-uniform time delays occur in the waveform reproduction section, during a period between the occurrence and detection of the advancement, due to differences in the respective operating step positions and states, so that the advancement detection times would contain irregular non-uniformity. Therefore, the calculations of the approximating function involve an operation to average the non-uniform detection times.

The above-mentioned "predetermined time" before the predicted detection time is a time allocated for forming a tone waveform and depends on the amount of necessary arithmetic operations for the waveform formation as determined by a desired number of tones to be generated, desired quality of the arithmetic operations, etc. The length of the "predetermined time" may be fixed, or may be variably set via a user's selection on the keyboard or automatically set by the CPU 101 in consideration of two or more simultaneously running programs.

Then, at step S763, a comparison is made between the next calculating point and the current time indicated by a timer, in order to determine whether the current time has arrived at the next calculating point. If the determination is in the affirmative, the processing performs operations of steps S764 to S769. First, at step S764, specific calculating order is decided in which the currently sounding channels should undergo the waveform sample calculations later to form waveform data for a plurality of samples for each of the currently sounding channels.

That is, the calculating order is set in such a manner that the waveform sample calculations are performed sequentially from a musically significant tone or tone which would present a significant musical inconvenience if deadened or muffled at that moment. Then, at step S765, it is ascertained whether the waveform sample calculations for all the currently sounding channels can be completed within a predetermined calculating time (i.e., the predetermined time described in relation to step S762). If answered in the negative, one or more tone generating channels where the waveform sample calculations are to be performed last or later than any other channels are designated as channels where tone is to be deadened (tone deadening channels), so that the amount of arithmetic operations is reduced in such a manner that the waveform sample calculations for all the currently sounding channels can be completed within the predetermined calculating time.

At step S78, the waveform sample calculations are actually performed. Specifically, uncalculated waveform samples are calculated and written into the currently available output buffer X so that the buffer X is filled with the calculated waveform data and thus gets ready for tone generation. This operation corresponds to the formation of waveform A3 or the like as described earlier in relation to FIG. 20.

Each sample written in the filled-up output buffer X is then subjected to a low-pass filtering (LPF) operation at step S767 so as to remove high frequency components therefrom. Following this, the output buffer X storing the low-pass filtered waveform is reserved at step S768 as a specific storage area for a waveform to be reproduced next, so that this storage area is reproduced after completion of reproduction of waveforms in the currently reproduced and already reserved storage areas. Then, at step S769, another output buffer than the one so far used as the buffer X is cleared and newly set as the output buffer X for preparing a waveform for the next to-be-reproduced section.

If the current time has not yet arrived at the calculating point as determined at step S763, the tone generating processing ends without the other operations being performed.

Figure 19:
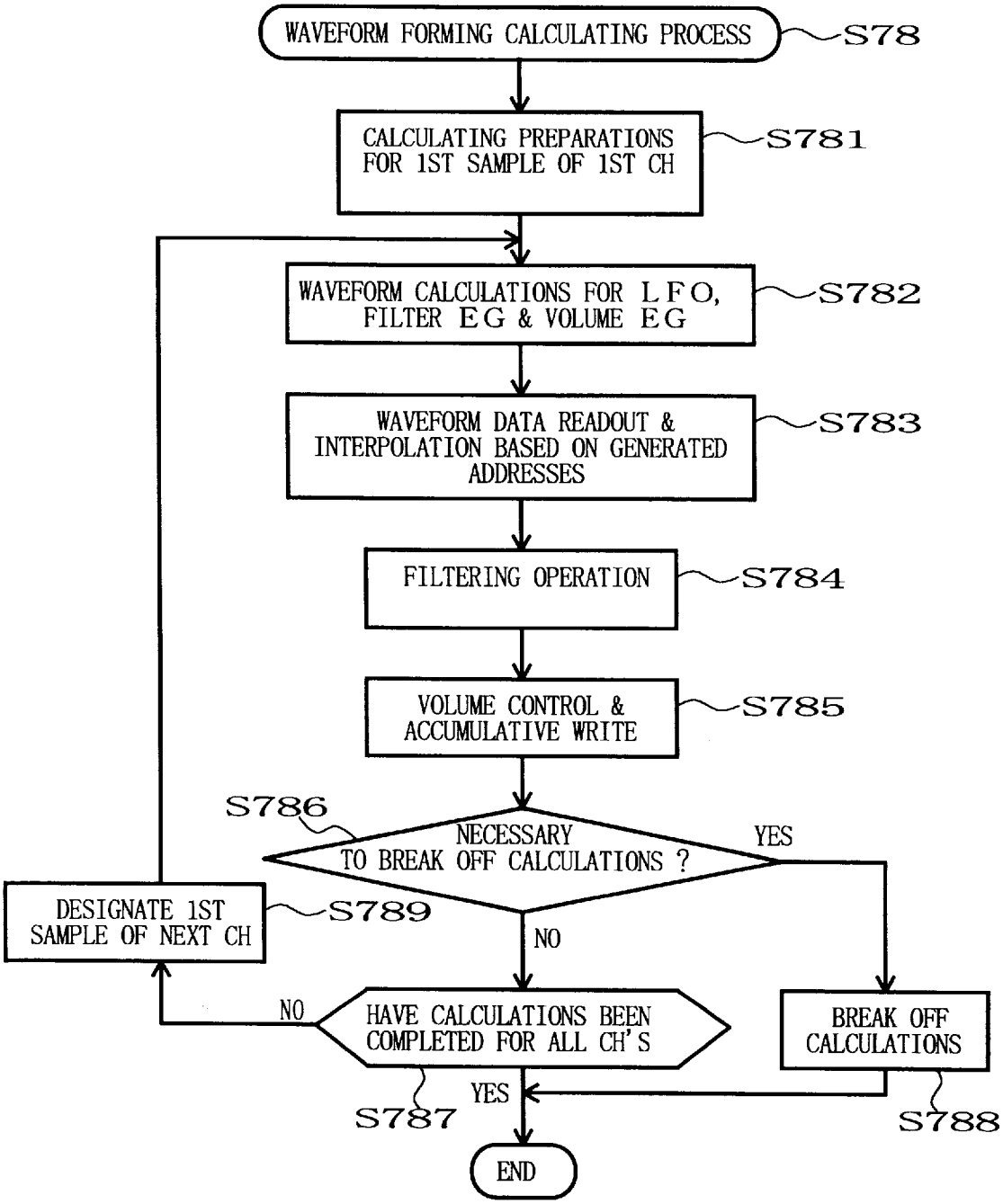
FIG. 19 is a flowchart illustrating an example of waveform calculation.

FIG. 19 is a flowchart of the waveform forming calculation process (step S78) performed in the note-on, note-off and tone generator processes. For this process, a waveform calculating time range is preset as previously mentioned. Namely, where the present program flow is executed during the MIDI data reception process such as the note-on process, the waveform calculating time range corresponds to the above-mentioned partial waveform, but where the present program flow is executed at step S76 of the tone generating processing, the waveform calculating time range corresponds to the waveform samples for an uncalculated section in the buffer X. Because the calculations are performed in the calculating order determined by the preceding execution of the tone generating processing, no new calculating order across the channels is determined at the time of MIDI data reception. Whenever a new note-on event occurs and is assigned to a specific one of the channels, the specific channel is placed first (given a first turn) in the calculating order and the turn of each of the other channels is moved down by one.

First, at step S781, calculating preparations are made for a first waveform sample of the channel placed first in the calculating order. The calculating preparations include setting various data such as a last read address, values and states (attack, release, etc.) of various envelopes EG and value of LFO in accessible conditions and loading these data into internal registers of the CPU 101 for immediate use in calculations. Then, at step S782, waveform sample calculations are performed on the LFO, filter G and tone volume EG, so as to form samples of LFO, FEG (filter envelope) and AEG (amplitude envelope) waveforms. The LFO waveform is added to the "F" number, FEG waveform and AEG waveform necessary for calculations of the designated time range, in order to modulate the respective data. For each of the tone generating channels designated as tone deadening channels at step 5765, a damping AEG waveform is calculated as a tone volume EG rapidly decaying within the time range.

Subsequently, at step S783, F number is repetitively added to the last read address used as an initial value, so as to generate read addresses for individual samples within the time range. Also, waveform data are read out from the waveform storage area in the tone color data area on the basis of the integer portion of the read addresses, and an interpolation is made between the read-out waveform samples on the basis of the decimal portion of the read addresses so as to form all interpolated samples within the time range. For example, if the timer range corresponds to a time for 100 samples, 100 samples are formed collectively by the operation of this step. Because, in the operation for the plural samples within the time range, the F number addition corresponding to the read address and interpolation are performed as an integral series of operations, the read address needs to be read into the CPU register only once, so that the processing speed can be substantially increased as a whole.

Further, at step S784, the interpolated samples within the time range are subjected to a tone color filtering operation, where tone color control of the samples is performed on the basis of the above-mentioned FEG waveform. At next step S785, an amplitude controlling operation is performed on the filtered samples so as to control the amplitudes of the samples on the basis of the above-mentioned AEG (amplitude envelope) and tone volume data, and then an accumulative writing operation is performed to add the resultant amplitude-controlled samples to the corresponding samples stored in the output buffer X for the designated channels. Because, in this process, the amplitude control and addition to the corresponding samples in the output buffer X are performed successively, it is possible to minimize the number of necessary sample loadings into the CPU register and hence significantly increase the processing speed.

The sample forming operations of steps S783 to S785 are performed basically to form all the samples within the predetermined time range, but those samples having sufficiently lowered AEG waveform level and hence sufficiently lowered tone volume as a result of the volume EG waveform calculations of step S782 are excluded from the further calculations, and accordingly the amount of necessary operations can be reduced. Particularly, sufficient decay may often be attained halfway in the predetermined time range, in the case of the tone generating channels having generated a damping AEG waveform in response to the designation of step S765.

Then, at step S786, a determination is made as to whether or not the waveform will be supplied to the waveform reproduction section within the time limit if the waveform forming calculation process is to be continued and whether the waveform sample calculations should be discontinued. The timely supply of the waveform within the time limit means herein that the reproduction section currently reproducing previously formed waveform samples from the specific storage area can prepare succeeding waveform samples in a new area of the buffer X and reserve the new area of the buffer X for subsequent reproduction before the reproduction of the previously formed waveform samples from the specific storage area is completed. If it is determined at step S786 that the waveform will not be supplied in time and the calculations should not be continued further, then the waveform sample calculations are discontinued at step S788 and the waveform calculating process ends.

If it is determined at step S786 that the calculations may be continued, a further determination is made at step S787 as to whether the waveform sample calculations have been completed for all of the designated channels. In answered in the negative, a first waveform sample in the tone generating channel placed next in the calculating order (given the next calculating turn) is designated at step S789 and preparations are made for calculating waveform samples in that next channel. Upon completion of such preparations, the processing reverts to step S782 so as to repeat the operations of steps S782 to S785 for that channel. In this way, the operations of steps S782 to S787 are repetitively performed for all the designated tone generating channels, and every time the operations are performed for one of the channels, the resultant formed samples for the predetermined time range are accumulatively added at step S785 to the corresponding samples stored in the buffer X.

When it is determined at step S787 that the waveform sample calculations have been completed for all of the designated channels, this waveform calculating process ends. Thus, a predetermined number of accumulated values of the formed waveform samples corresponding to the time range have now been newly stored for all of the designated channels.

When the waveform sample calculations are discontinued on the basis of the affirmative determination at step S786, the predetermined number of accumulated values of the formed waveform samples corresponding to the time range have now been newly stored for each of the designated channels.

For each of the channels having the calculating turn later than the discontinuation of the calculations, no waveform sample formation is effected, and as the result, the tone having been generated through the channel will be deadened. However, because those channels generating less important tones are given later turns in the calculating order at step S764, adverse effects occurring from the discontinuation can be minimized. Channel register CH is set at step S788 in such a manner that the channels thus excluded from the calculations remain in the even in and d condition even in and after next execution of the waveform forming calculation process.

In the above-mentioned manner, tone waveform samples can be arithmetically formed through the operations of the CPU 101.

While the present invention has been described above downloading an optimum tone generator program or optimum waveform data by use of user profile information possessed by the terminal devices, such user profile information may be prestored in the host computer 10 or may be transferred from one of the terminal devices to the host computer 10 at the LOGIN time so that when there is a download request from the terminal device, the host computer 10 can refer to the user profile information to select and transmit optimum data or program.

In a modification, the host may send a list of available waveform data for each music piece so that the terminal device requests a transfer of only a selected part of the waveform data that is not possessed by the device.

As has been described thus far, the present invention permits downloading of optimum data or program and facilitates a selection of data to be loaded, depending on system and program-possessing conditions in the user system. Thus, it is possible to prevent irrelevant or data from being downloaded and also prevent an increase in network traffic.

In addition, it is possible to avoid loading unnecessary data or program from a recording medium such as a CD-ROM. For example, where a PCM tone generator is employed, standard waveform data may be stored in each of the terminal devices, and for a music piece using special waveform data, that special waveform data may be loaded along with the music piece data. This arrangement prevents musical expression from becoming worse due to a mismatch between the tone generator and MIDI data.

What is claimed is:

1. A musical information processing system comprising:

a processing device;

a storage device connected with said processing device and having stored therein at least first data, said first data defining music or a music performance and also containing specific information that designates various data including second data necessary for executing predetermined processing based on said first data; and a data supply device connected with said processing device and said storage device and having stored therein various data, wherein to execute said predetermined processing based on said first data, said processing device sends said data supply device a request for transfer of said second data necessary for the predetermined processing if said second data is not stored in said storage device, and said data supply device transfers said second data to said storage device in response to the request for transfer.

2. A musical information processing system comprising:

a processor device for executing predetermined processing on the basis of first and second data;

a memory device connected with said processor device and having stored therein at least said first data; and a data supply device connected with said processor device via a network and having stored therein at least said second data, wherein said processor device performs a first operation for determining whether or not said second data necessary for the predetermined processing is stored in said memory device, a second operation for, if said first operation determines that said second data necessary for the predetermined processing is not stored in said memory device, making a request to said data supply device to transfer the necessary second data via the network and a third operation for loading the necessary second data transferred from said data supply device into said memory device, so as to execute the predetermined processing on the basis of said first and second data stored in said memory device, and in response to the request from said processor device, said data supply device supplies the necessary data to said processor device via the network.

3. A musical information processing system comprising:

a processor device for executing predetermined processing on the basis of first and second data;

a memory device connected with said processor device and for storing therein said first and second data; and a data supply device connected with said processor device via a network and including a database having stored therein plural sorts of said first and second data, wherein said processor device performs a first operation for designating desired first data from among plural sorts of said first data and making a request to said data supply device to transfer the designated first data, a second operation for determining whether or not said second data to be used in correspondence with the designated first data is already stored in said memory device, a third operation for, if said second operation determines that said second data is not stored in said memory device, making a request to said data supply device to transfer said second data and a fourth operation for loading said designated first data and second data transferred from said data supply device into said memory device, so as to execute the predetermined processing on the basis of said first and second data stored in said memory device, and in response to the request from said processor device, said data supply device supplies said designated first data and said second data to said processor device via the network.

4. A musical information processing system comprising:

a processor device for executing predetermined processing on the basis of first and second data;

a memory device connected with said processor device and for storing therein said first and second data; and a data supply device connected with said processor device via a network and including a database having stored therein plural sorts of said first and second data, wherein said processor device performs a first operation for designating desired first data from among the plural sorts of said first data and making a request to said data supply device to transfer the designated first data, a second operation for permitting a mode selection between a first mode for making a request for transfer of only the designated first data and a second mode for making a request for transfer of the designated first data and said second data to be used in correspondence with the designated first data, a third operation for, if said second mode is selected, determining whether or not said second data to be used in correspondence with the designated first data is already stored in said memory device, a fourth operation for, if said third operation determines that said second data is not stored in said memory device, making a request to said data supply device to transfer said second data and a fifth operation for loading said designated first data and second data transferred from said data supply device into said memory device, so as to execute the predetermined processing on the basis of said first and second data stored in said memory device, and in response to the request from said processor device, said data supply device supplies said designated first data and second data to said processor device via the network.

5. A musical information processing system comprising:

a processor device for executing predetermined processing on the basis of first and second data;

a memory device connected with said processor device and having stored therein at least said first data; and a data supply device connected with said processor device and memory device and including a memory having stored therein at least said second data, wherein said processor device performs a first operation for determining whether or not said second data necessary for the predetermined processing is stored in said memory device, a second operation for, if said first operation determines that said second data necessary for the predetermined processing is not stored in said memory device, making a request to said data supply device to transfer the necessary second data and a third operation for loading the necessary second data transferred from said data supply device into said memory device, so as to execute the predetermined processing on the basis of said first and second data stored in said memory device, and in response to the request from said processor device, said data supply device reads out the necessary second data from said memory and supplies the read-out necessary second data to said processor device.

6. A musical information processing system comprising:

a processor device for executing predetermined processing on the basis of first and second data;

a memory device connected with said processor device and for storing therein said first and second data; and a data supply device connected with said processor device and memory device and including a memory having stored therein plural sorts of said first and second data;

wherein said processor device performs a first operation for selecting one of a plurality of the predetermined processing to be executed, a second operation for reading out from said memory of said data supply device said first data necessary for the selected predetermined processing and loading the read-out first data into said memory device, a third operation for determining whether or not said second data necessary for the selected predetermined processing is already stored in said memory device, a fourth operation for, if said third operation determines that said second data necessary for the selected predetermined processing is not stored in said memory device, making a request to said data supply device to transfer the necessary second data and a fifth operation for loading the necessary second data transferred from said data supply device into said memory device, so as to execute the selected predetermined processing on the basis of said first and second data stored in said memory device, and in response to the request from said processor device, said data supply device reads out the necessary second data from said memory and supplies the read-out necessary second data to said processor device.

7. A musical information processing system as claimed in claim 6 wherein said fourth operation determines whether or not said necessary second data is stored in said memory of said data supply device, and wherein if said necessary second data is stored in said memory, said fourth operation requests said data supply device to transfer said necessary second data, but if said necessary second data is not stored in said memory, said fourth operation requests said data supply device to transfer any of the plural sorts of said second data as a substitute for said necessary second data.

8. A musical information processing system as claimed in claim 6 wherein said first data contains designation information for designating said necessary second data, and wherein said third operation refers to the designation information contained in said first data read out from said memory in said second operation, so as to determine whether or not said second data necessary for the selected predetermined processing is already stored in said memory device.

9. A musical information processing system comprising:

a processor device for executing music reproduction processing on the basis of first data containing music data for automatic performance and second data related to said first data;

a memory device connected with said processor device and having stored therein at least said first data; and a data supply device connected with said processor device via a network and including a database having stored therein various data including at least plural sorts of said second data;

wherein said first data contains designation information for designating said second data necessary for reproduction of the music data, said processor device performs a first operation for, in order to execute a reproductive performance of a selected music piece, making a request to said data supply device, via the network, to transfer said second data designated by said designation information contained in said first data for the music piece and a second operation for loading said second data transferred from said data supply device into said memory device, so as to execute the music reproduction processing of the selected music piece on the basis of said first and second data stored in said memory device, and in response to the request from said processor device, said data supply device supplies said second data to said processor device via the network.

10. A musical information processing system comprising:

a processor device for executing music reproduction processing on the basis of first data containing music data for automatic performance and second data related to said first data;

a memory device connected with said processor device and having stored therein at least said first data; and a data supply device connected with said processor device and memory device and including a memory having stored therein various data including at least plural sorts of said second data;

wherein said first data contains designation information for designating said second data necessary for reproduction of the music data, said processor device performs a first operation for, in order to execute a reproductive performance of a selected music piece, making a request to said data supply device to transfer said second data designated by said designation information contained in said first data for the music piece and a second operation for loading said second data transferred from said data supply device into said memory device, so as to execute the music reproduction processing of the selected music piece on the basis of said first and second data stored in said memory device, and in response to the request from said processor device, said data supply device supplies said second data to said processor device.

11. A method of transferring musical data from a database to a memory device in a system which includes the memory device, a processor device for executing predetermined processing on the basis of data stored in the memory device and the database having stored therein various data including musical data, the predetermined processing being executed on the basis of first data specific to the predetermined processing and second data usable for not only the predetermined processing but also other processing, said method comprising the steps of:

making a request to said database to transfer desired said first data;

determining whether or not said second data necessary for the execution of the predetermined processing based on said desired first data is stored in said memory device;

making a request to said database to transfer said necessary second data if said step of determining determines that said necessary second data is not stored in said memory device; and in response to the request, loading said first and second data transferred from said data base into said memory device.

12. A method of transferring musical data from a database to a memory device in a system which includes the memory device, a processor device for executing predetermined processing on the basis of data stored in the memory device and the database having stored therein various data including musical data, the predetermined processing being executed on the basis of first data specific to the predetermined processing and second data usable for execution of not only the predetermined processing but also other processing, the memory device having stored therein at least said first data, said method comprising the steps of:

determining whether or not said second data necessary for the execution of the predetermined processing is stored in said memory device, when the processing is to be executed;

making a request to said database to transfer said necessary second data if said step of determining determines that said necessary second data is not stored in said memory device; and in response to the request, loading said second data transferred from said data base into said memory device.

13. A machine readable recording medium containing a group of instructions to cause said machine to implement a method of transferring musical data from a database to a memory device in a system which includes the memory device, a processor device for executing predetermined processing on the basis of data stored in the memory device and the database having stored therein various data including musical data, the predetermined processing being executed on the basis of first data specific to the predetermined processing and second data usable for execution of not only the predetermined processing but also other processing, said method comprising the steps of:

making a request to said database to transfer desired said first data;

determining whether or not said second data necessary for the execution of the predetermined processing based on said desired first data is stored in said memory device;

making a request to said database to transfer said necessary second data if said step of determining determines that said necessary second data is not stored in said memory device; and in response to the request, loading said first and second data transferred from said data base into said memory device.

14. A machine readable recording medium containing a group of instructions to cause said machine to implement a method of transferring musical data from a database to a memory device in a system which includes the memory device, a processor device for executing predetermined processing on the basis of data stored in the memory device and the database having stored therein various data including musical data, the predetermined processing being executed on the basis of first data specific to the predetermined processing and second data usable for execution of not only the predetermined processing but also other processing, the memory device having stored therein at least said first data, said method comprising the steps of:

determining whether or not said second data necessary for the execution of the predetermined processing is stored in said memory device, when the processing is to be executed;

making a request to said database to transfer said necessary second data if said step of determining determines that said necessary second data is not stored in said memory device; and in response to the request, loading said second data transferred from said data base into said memory device.

* * * * *